US007953331B2

(12) United States Patent
Oshige et al.

(10) Patent No.: US 7,953,331 B2
(45) Date of Patent: May 31, 2011

(54) DEVELOPER CARRYING DEVICE, DEVELOPING DEVICE, PROCESS UNIT, AND IMAGE FORMING APPARATUS

(75) Inventors: Wakako Oshige, Tokyo (JP); Shinji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 314 days.

(21) Appl. No.: 12/093,753

(22) PCT Filed: Sep. 13, 2007

(86) PCT No.: PCT/JP2007/068323

§ 371 (c)(1),
(2), (4) Date: May 15, 2008

(87) PCT Pub. No.: WO2008/035751

PCT Pub. Date: Mar. 27, 2008

(65) Prior Publication Data

US 2009/0116861 A1 May 7, 2009

(30) Foreign Application Priority Data

Sep. 19, 2006 (JP) ..... 2006-253304
Jul. 23, 2007 (JP) ..... 2007-190766

(51) Int. Cl.
*G03G 15/08* (2006.01)
*G03G 15/10* (2006.01)

(52) U.S. Cl. ..... 399/30; 399/62

(58) Field of Classification Search ..... 399/30, 399/62, 58, 254, 256
See application file for complete search history.

(56) References Cited

U.S. PATENT DOCUMENTS 5,231,452 A 7/1993 Murayama et al.
5,327,196 A 7/1994 Kato et al.
5,387,965 A 2/1995 Hasegawa et al.
5,475,476 A 12/1995 Murai et al.
(Continued)

FOREIGN PATENT DOCUMENTS

JP 60 140969 * 9/1985
(Continued)

OTHER PUBLICATIONS

Machine translation of Okada et al. (Pub No. JP 06-308833) Apr. 11, 1994.*

*Primary Examiner* — David M Gray
*Assistant Examiner* — Rodney Bonnette
(74) *Attorney, Agent, or Firm* — Oblon, Spivak, McClelland, Maier & Neustadt, L.L.P.

(57) ABSTRACT

A pressing wall is provided in a part of the entire area of the first carrying chamber in which a first screw member is housed. The area is opposed to a bottom wall of the first carrying chamber on the lower side in the gravity direction of the first screw member and opposed to the side walls of the first carrying chamber on both lateral sides orthogonal to a rotation axis direction of the first screw member. In the area, a toner concentration of a K developer being carried is detected by a K toner concentration sensor. The pressing wall comes into contact with, from above in the gravity direction, the K developer, which moves from a lower side to an upper side in the gravity direction according to the rotation of the first screw member, and presses the K developer downward in the gravity direction.

18 Claims, 18 Drawing Sheets

U.S. PATENT DOCUMENTS

| | | | | |
|---|---|---|---|---|
| 5,493,382 | A | 2/1996 | Takagaki et al. | |
| 5,572,299 | A | 11/1996 | Kato et al. | |
| 5,671,470 | A | 9/1997 | Maruta et al. | |
| 5,765,059 | A | 6/1998 | Kosuge et al. | |
| 5,860,038 | A | 1/1999 | Kato et al. | |
| 5,970,276 | A | 10/1999 | Kato | |
| 6,081,678 | A | 6/2000 | Kato | |
| 6,195,519 | B1 | 2/2001 | Isobe et al. | |
| 6,526,235 | B2 | 2/2003 | Kato | |
| 6,594,453 | B2 | 7/2003 | Kato | |
| 6,597,881 | B2 | 7/2003 | Hatori et al. | |
| 6,798,996 | B2 | 9/2004 | Sawada et al. | |
| 7,003,238 | B2 | 2/2006 | Yoshida et al. | |
| 7,024,133 | B2 | 4/2006 | Nagashima et al. | |
| 7,136,610 | B2 * | 11/2006 | Arai et al. | |
| 7,190,912 | B2 * | 3/2007 | Kato | |
| 7,203,433 | B2 * | 4/2007 | Kato et al. | |
| 7,228,081 | B2 * | 6/2007 | Hasegawa et al. | |
| 7,251,420 | B2 * | 7/2007 | Fujimori et al. | |
| 7,260,335 | B2 | 8/2007 | Kato et al. | |
| 7,305,203 | B2 * | 12/2007 | Sampe et al. | |
| 7,343,132 | B2 | 3/2008 | Kimura et al. | |
| 2003/0175050 | A1 * | 9/2003 | Murayama et al. | 399/256 |
| 2005/0013636 | A1 * | 1/2005 | Sawai et al. | |
| 2006/0008296 | A1 * | 1/2006 | Sampe et al. | |
| 2006/0018680 | A1 * | 1/2006 | Hosokawa et al. | |
| 2006/0115292 | A1 | 6/2006 | Sampe et al. | |
| 2006/0120741 | A1 * | 6/2006 | Murakami et al. | 399/49 |
| 2006/0274628 | A1 | 12/2006 | Tanaka et al. | |
| 2007/0019976 | A1 | 1/2007 | Watanabe et al. | |
| 2007/0025748 | A1 | 2/2007 | Ishibashi et al. | |
| 2007/0036566 | A1 | 2/2007 | Takeuchi et al. | |
| 2007/0065164 | A1 | 3/2007 | Fujimori et al. | |
| 2007/0104499 | A1 | 5/2007 | Ariizumi et al. | |
| 2007/0110457 | A1 | 5/2007 | Kato et al. | |
| 2007/0116480 | A1 | 5/2007 | Takeuchi et al. | |
| 2007/0122168 | A1 | 5/2007 | Tanaka et al. | |
| 2007/0122169 | A1 | 5/2007 | Shimizu et al. | |
| 2007/0122171 | A1 | 5/2007 | Fujimori et al. | |
| 2007/0134014 | A1 | 6/2007 | Kato et al. | |
| 2008/0025763 | A1 * | 1/2008 | Suenami | 399/256 |
| 2008/0069580 | A1 * | 3/2008 | Oshige et al. | 399/62 |
| 2009/0257761 | A1 * | 10/2009 | Kato et al. | 399/30 |

FOREIGN PATENT DOCUMENTS

| | | | |
|---|---|---|---|
| JP | 63 98681 | * | 4/1988 |
| JP | 63 149677 | * | 6/1988 |
| JP | 4 11558 | * | 1/1992 |
| JP | 4 29273 | | 1/1992 |
| JP | 5 127537 | | 5/1993 |
| JP | 5 197289 | | 8/1993 |
| JP | 6 308833 | | 11/1994 |
| JP | 7 271175 | * | 10/1995 |
| JP | 11 202610 | * | 7/1999 |
| JP | 2002 304050 | | 10/2002 |
| JP | 3375986 | * | 11/2002 |
| JP | 2003 156985 | * | 5/2003 |
| JP | 2003 307918 | * | 10/2003 |
| JP | 2004 139031 | * | 5/2004 |
| JP | 2005 164827 | | 6/2005 |
| JP | 2005 266058 | * | 9/2005 |

* cited by examiner

FIG.9
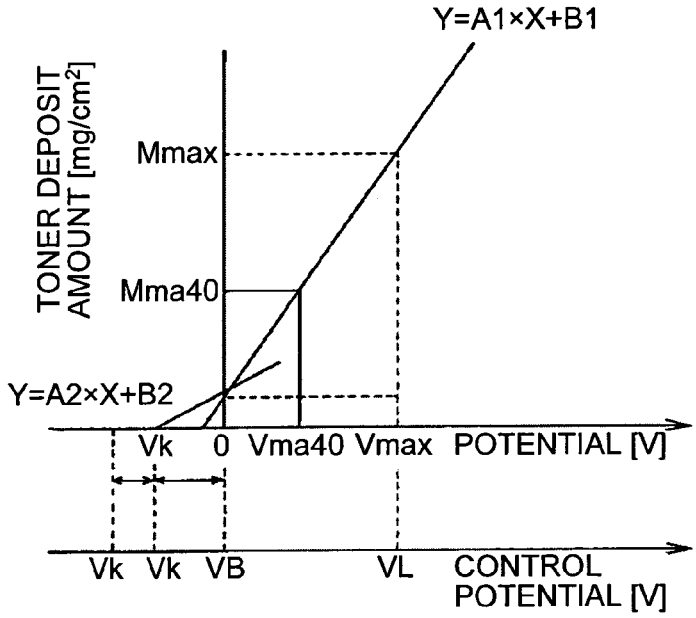
FIG.10
| NO. | Vmax | VD | VB | VL |
|---|---|---|---|---|
| 1 | 160 | 400 | 260 | 110 |
| 2 | 180 | 429 | 286 | 118 |
| 3 | 200 | 457 | 311 | 126 |
| 4 | 220 | 486 | 337 | 133 |
| 5 | 240 | 514 | 363 | 141 |
| ⋮ | ⋮ | ⋮ | ⋮ | ⋮ |
| 16 | 460 | 829 | 646 | 226 |
| 17 | 480 | 857 | 671 | 234 |
| 18 | 500 | 886 | 697 | 241 |
| 19 | 520 | 914 | 723 | 249 |
| 20 | 540 | 943 | 749 | 257 |
FIG.11
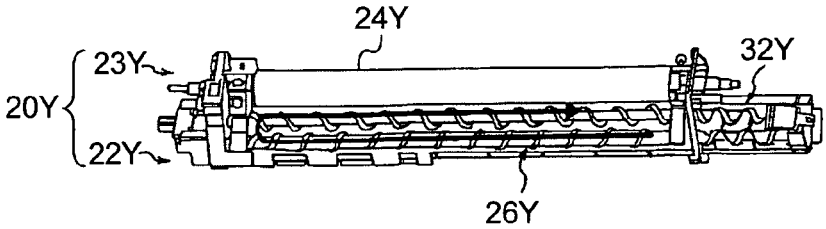

DEVELOPER CARRYING DEVICE, DEVELOPING DEVICE, PROCESS UNIT, AND IMAGE FORMING APPARATUS

CROSS-REFERENCE TO RELATED APPLICATIONS

This application claims the benefit of priority from the prior Japanese Patent Application No. 2006-253304, filed Sep. 19, 2006, and prior Japanese Patent Application No. 2007-190766, filed Jul. 23, 2007.

TECHNICAL FIELD

The present invention relates to a developer carrying device for use in an image forming apparatus.

BACKGROUND ART

A developer carrying device is used in an image forming apparatus. The developer carrying device carries a developer containing a toner and a magnetic carrier. The developer carrying device includes an agitating and carrying member that carries the developer in an axial direction while agitating the developer according to the rotation of the agitating and carrying member. The developer carrying device also includes a toner-concentration detecting unit that detects a toner concentration of the developer carried by the agitating and carrying member.

The agitating and conveying member, which is generally a screw member, carries the developer to an area opposed to a latent image bearing member according to the surface movement of a developer bearing member, which is generally a sleeve, while bearing the developer on the surface of the developer bearing member. The developing device transfers the toner in the developer onto a latent image on the latent image bearing member to develop the latent image and obtain a toner image. The developer that has contributed to the development is returned onto the agitating and conveying member in the developing device according to the movement of the developer bearing member. The toner concentration of the developer is detected by the toner-concentration detecting unit while the developer is carried by the agitating and carrying member. The developer is replenished with an appropriate amount of the toner based on a result of the detection and supplied to the developer carrying member again.

Sometimes the volume of the toner in the developer changes due to environmental fluctuation or fluctuation in an amount of electric charge on the toner. In this situation, although the toner concentration has not changed, the conventional toner-concentration detecting unit erroneously detects a change in the concentration of the toner. Such misdetection can be prevented by pressing the developer strongly in a position of detection by the toner-concentration detecting unit to adjust the amount of the toner that affects the toner concentration. For example, Japanese Patent Application Laid-Open No. 6-308833 discloses (see FIG. 10) a graph indicating that a result of detection by a permeability sensor as a toner-concentration detecting unit can be fixed regardless of an amount of charge of a toner by pressing a developer with a force equal to or larger than 30 [g/cm$^2$] (9.8×300N/cm$^2$).

DISCLOSURE OF INVENTION

According to an aspect of the present invention, there is provided a developer carrying device including a developer carrying unit that carries a developer containing a toner and a carrier in a rotation axis direction while agitating the developer with a agitating and carrying member; and a toner-concentration detecting unit that detects a toner concentration in the developer carried in the developer carrying unit. A pressing wall is provided in an area in a part of an entire area in a developer carrying direction in the developer carrying unit, the pressing wall coming into contact with, from above in the gravity direction, the developer that moves from a lower side to an upper side in the gravity direction according to the rotation of the agitating and carrying member and pressing the developer downward in the gravity direction. The area is opposed to a bottom wall of the developer carrying unit on a lower side in a gravity direction of the agitating and carrying member and opposed to side walls of the developer carrying unit on both lateral sides orthogonal to the rotation axis direction of the agitating and carrying member. The toner concentration of the developer being carried is detected by the toner-concentration detecting unit in the area.

According to another aspect of the present invention, there is provided a developing device including a developer carrying device that carries a developer containing a toner and a carrier; and a developer bearing member that carries the developer, which is carried by the developer carrying device, to an area opposed to a latent-image bearing member according to surface movement of the developer bearing member while bearing the developer on an endlessly-moving surface thereof and develops a latent image born on the latent-image bearing member. The above developer carrying device is used as the developer carrying device.

According to still another aspect of the present invention, there is provided a process unit in an image forming apparatus including a latent-mage bearing member that bears a latent image, a developing device that develops the latent image on the latent-image bearing member, and a transfer unit that transfers a visual image developed on the image bearing member onto a transfer member, the process unit holding at least the latent-image bearing member and the developing device in a common holding member as one unit and being detachably mounted integrally on in an image forming apparatus main body. The above developing device is used as the developing device.

According to still another aspect of the present invention, there is provided an image forming apparatus including a latent-image bearing member that bears a latent image; and a developing device that develops the latent image on the latent-image bearing unit. The above developing device is used as the developing device.

The above and other objects, features, advantages and technical and industrial significance of this invention will be better understood by reading the following detailed description of presently preferred embodiments of the invention, when considered in connection with the accompanying drawings.

BRIEF DESCRIPTION OF DRAWINGS

FIG. 9 is a graph for explaining data in a section where a relation between potential and a toner deposit amount of a reference latent image is linear;

FIG. 10 depicts an example of contents of a potential control table;

FIG. 11 is a disassembled perspective view of a developing device for Y shown in FIG. 3;

BEST MODE(S) FOR CARRYING OUT THE INVENTION

Figure 1:
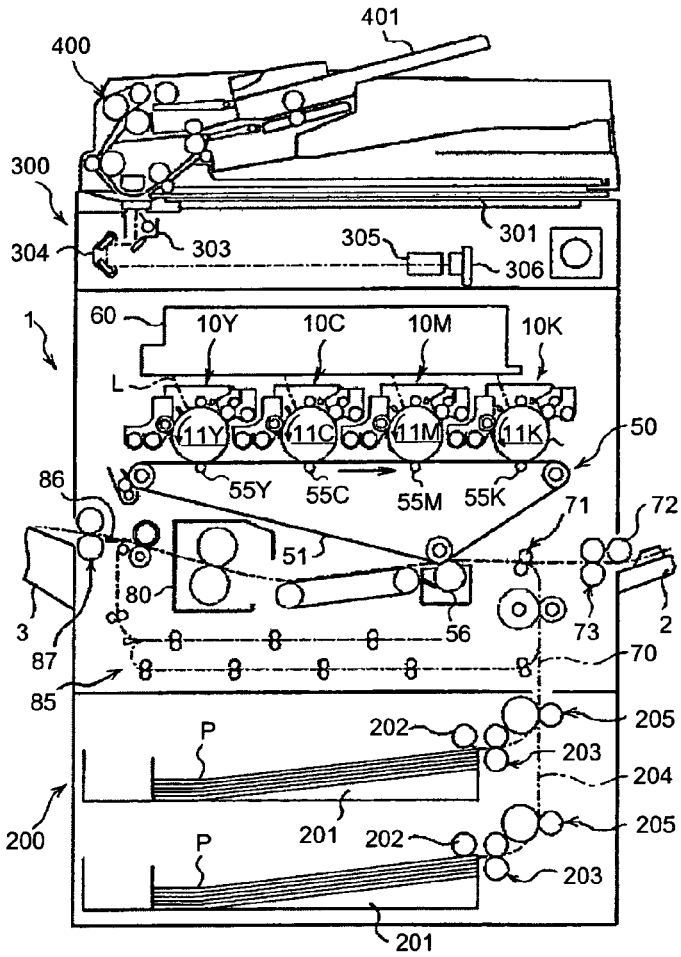
FIG. 1 is a schematic diagram of a copying machine according to an embodiment of the present invention.

The inventors found through experiments that, in actual use, the permeability sensor does not always show an output characteristic indicated by the graph shown in FIG. 10 of Japanese Patent Application Laid-Open No. 6-308833. Specifically, the developer disclosed in Japanese Patent Application Laid-Open No. 6-308833 carries the developer in a rotation axis direction according to the rotation of a screw member as an agitating and carrying member disposed in a developer carrying unit. The toner-concentration detecting unit fixed to a lower wall of the developer carrying unit detects a toner concentration of the developer being carried. Surface roughening is applied to an inner wall of the developer carrying unit further on a downstream side in a developer carrying direction than a position for toner concentration detection by the toner-concentration detecting unit. Carrying speed of the developer is reduced in a section of the surface roughening to press the developer in the toner concentration detection position, which is further on an upstream side in the developer carrying direction than the surface roughening section, in the developer carrying direction. However, according to the experiments by the inventors, in such a developing device, a pressing force in the developer carrying direction applied to the developer and a result of detection by the toner concentration sensor including the permeability sensor did not show a satisfactory correlation.

Therefore, the inventors carried out further experiments and found that a satisfactory correlation was not obtained between the pressing force in the developer carrying direction applied to the developer and the result of detection by the toner concentration sensor because of the following reasons. A certain degree of clearance is provided between a wall of the developer carrying unit including the screw member and a spiral blade of the screw member. The toner concentration sensor fixed to the wall of the developer carrying unit has a relatively small detectable distance range. Thus, the toner concentration sensor cannot detect a toner concentration of the developer in the spiral blade in a relatively distant position. The toner concentration sensor can detect only a toner concentration of the developer in the clearance near the sensor. Therefore, the developer in the clearance has to be sufficiently pressed. However, a pressing force in a rotation axis direction (a conveying direction) following the rotation of the screw member mainly acts on the developer stored in the spiral blade of the screw member. Even if the developer in the spiral blade is sufficiently pressed, the developer in the clearance further on the outer side than the spiral blade may not be sufficiently pressed. Consequently, a satisfactory correlation is not obtained between the pressing force in the developer carrying direction applied to the developer and the result of detection by the toner concentration sensor.

Exemplary embodiments of the present invention are explained in detail below with reference to the accompanying drawings.

FIG. 1 is a schematic diagram of a copying machine according to an embodiment of the present invention. The copying machine includes a printer unit 1 that forms an image on a recording sheet P, a sheet feeding device 200 that feeds the recording sheet P to the printer unit 1, a scanner 300 that scans an original image, and an original automatic document feeder (hereinafter, "ADF") 400 that automatically feeds an original (document) to the scanner 300.

In the scanner 300, according to the reciprocating movement of a first traveling member 303 mounted with a light source for original illumination, a mirror, and the like and a second traveling member 304 mounted with a plurality of reflection mirrors, scanning of an original (not shown) placed on a contact glass 301 is performed. Scanning light irradiated from the second traveling member 304 is condensed by a focusing lens 305 on a focusing surface of a reading sensor 306 set behind the focusing lens 305. The scanning light is then read as an image signal by the reading sensor 306.

On a side of a housing of the printer unit 1, a manual feed tray 2 on which the recording sheet P fed into the housing is manually placed and a sheet discharge tray 3 on which the recording sheet P after image formation discharged from the housing is stacked are provided.

Figure 2:
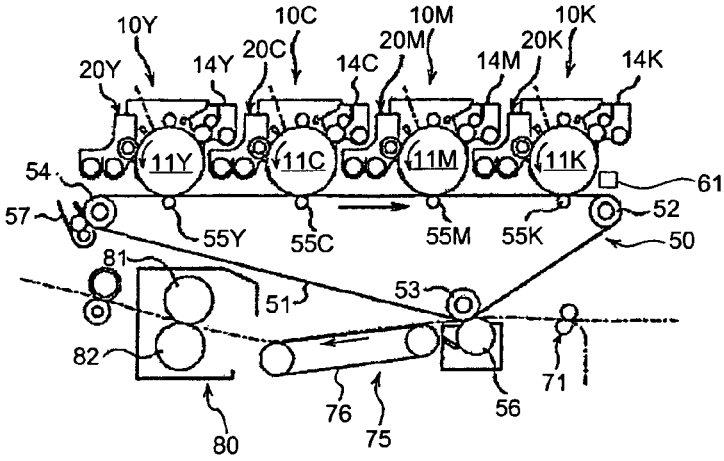
FIG. 2 is a partial enlarged diagram of a part of an internal structure of a printer unit in the copying machine shown in FIG. 1.

FIG. 2 is a partial enlarged diagram of a part of an internal structure of the printer unit 1. A transfer unit 50 in which an endless intermediate transfer belt 51 as a transfer member is stretched by a plurality of stretching rollers is disposed in the housing of the printer unit 1. The intermediate transfer belt 51 is made of a material formed by dispersing carbon powder for adjusting electric resistance in less stretchable polyimide resin. The intermediate transfer belt 51 is endlessly rotated in a clockwise direction in the figure by the rotation of a driving roller 52, which is driven to rotate in the clockwise direction in the figure by a not-shown driving unit, while being stretched by the driving roller 52, a secondary transfer backup roller 53, a driven roller 54, and four primary transfer rollers 55Y, 55C, 55M, and 55K. The subscripts Y, C, M, and Y affixed to the ends of the signs of the primary transfer rollers indicate that the primary transfer rollers are members for yellow, cyan, magenta, and black. The same holds true for subscripts Y, C, M, and Y affixed to the ends of signs in the following explanation.

The intermediate transfer belt 51 is stretched in a posture of a reverse triangular shape with a bottom side thereof faced upward in the vertical direction because the intermediate transfer belt 51 is substantially curved in sections where the intermediate transfer belt 51 is laid over the driving roller 52, the secondary transfer backup roller 53, and the driven roller 54. A belt upper stretch surface equivalent to the bottom side of the reverse triangular shape extends in the horizontal direction. Above such a belt upper stretch surface, four process units 10Y, 10C, 10M, and 10K are disposed side by side in the horizontal direction along the extending direction of the upper stretch surface.

As shown in FIG. 1, an optical writing unit 60 is disposed above the four process units 10Y, 10C, 10M, and 10K. The optical writing unit 60 drives, based on image information of an original scanned by the scanner 300, four semiconductor lasers (not shown) using a not-shown laser control unit and emits four writing lights L. The optical writing unit 60 scans drum-like photosensitive members 11Y, 11C, 11M, and 11K as latent image bearing members of the process units 10Y, 10C, 10M, and 10K using the writing lights L, respectively, in the dark and writes electrostatic latent images for Y, C, M, and K on the surfaces of the photosensitive members 11Y, 11C, 11M, and 11K.

The optical writing unit 60 is an optical writing unit that performs optical scanning by reflecting a laser beam emitted from a semiconductor laser on a not-shown reflection mirror or transmitting the laser beam through an optical lens while deflecting the laser beam with a not-shown polygon mirror. Instead of such an optical writing unit, an optical writing unit that performs optical scanning with an LED array can be used.

Figure 3:
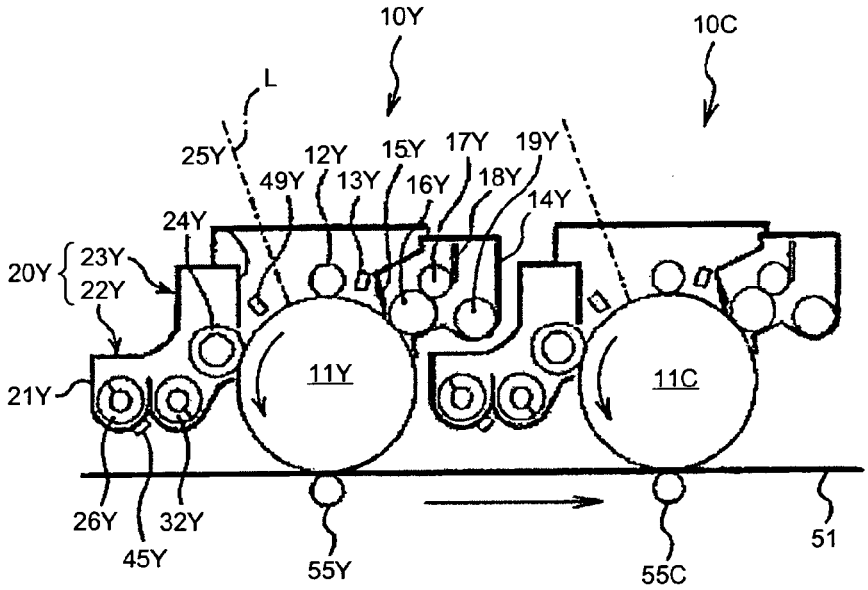
FIG. 3 is an enlarged diagram of process units for yellow (Y) and cyan (C) shown in FIG. 2.

FIG. 3 is an enlarged diagram of the process units 10Y and 10C and the intermediate transfer belt 51. The process unit 10Y includes, around the drum-like photosensitive member 11Y, a charging member 12Y, a charge removing device 13Y, a drum cleaning device 14Y, a developing device 20Y, and a Y-potential sensor 49Y. The process unit 10Y and these devices are detachably attachable to the printer unit integrally as one unit with the devices held by a casing as a common holding member.

The charging member 12Y is a roller-like member rotatably supported by a not-shown bearing while coming into contact with the photosensitive member 11Y. The charging member 12Y rotates in contact with the photosensitive member 11Y while being applied with a charging bias by a not-shown bias supplying unit to uniformly charge the surface of the photosensitive member 11Y in, for example, a polarity same as a charging polarity of a Y toner. A scorotron charger or the like that applies uniform charging processing to the photosensitive member 11Y in a non-contact manner can be adopted instead of such a charging member 12Y.

The developing device 20Y includes a casing 21Y, a developer carrying device 22Y, and a developing unit 23Y. The casing 21Y is filled with a Y developer. The Y developer is a mixture of a magnetic carrier and a nonmagnetic Y toner. In the developing unit 23Y, a developing sleeve 24Y as a developer carrying member, which is driven to rotate by a not-shown driving unit to endlessly move the surface thereof, exposes a part of a peripheral surface thereof to the outside from an opening provided in the casing 21Y. Consequently, a development area in which the photosensitive member 11 and the developing sleeve 24Y are opposed to each other via a predetermined gap is formed.

In the inside of the developing sleeve 24Y made of a nonmagnetic member of a hollow pipe shape, a magnet roller (not-shown) including a plurality of magnetic poles arranged in the peripheral direction is fixed to not rotate following the developing sleeve 24Y. The developing sleeve 24Y is driven to rotate while attracting the Y developer in a developer carrying device 22 described later to the surface thereof with a magnetic force generated by the magnet roller. In this way, the developing sleeve 24Y draws up the Y developer from the developer carrying device 22Y. The Y developer carried to the development area according to the rotation of the developing sleeve 24Y enters a doctor gap of 0.9 [mm] formed between a doctor blade 25Y, the tip of which is opposed to the surface of the developing sleeve 24Y via a predetermined gap, and the sleeve surface. A layer thickness on the sleeve is regulated to be equal to or smaller than 0.9 [mm]. When the Y developer is carried to near the development area opposed to the photosensitive member 11Y according to the rotation of the developing sleeve 24Y, the Y developer is subjected to a magnetic force of a not-shown developing magnetic pole of the magnet roller and stands like the ears of rice on the sleeve to become a magnetic brush.

For example, a developing bias having a polarity same as a charging polarity of a toner is applied to the developing sleeve 24Y by the not-shown bias supplying unit. Consequently, in the development area, between the surface of the developing sleeve 24Y and a non-image section (a uniformly charged section, i.e., a background section) of the photosensitive member 11Y, a no-development potential for electrostatically moving the Y toner from the non-image section side to the sleeve side acts. Between the surface of the developing sleeve 24Y and the electrostatic latent image on the photosensitive member 11Y, a development potential for electrostatically moving the Y toner from the sleeve side to the electrostatic latent image acts. When the Y toner in the Y developer is transferred to the electrostatic latent image by the action of the development potential, the electrostatic latent image on the photosensitive member 11Y is developed by the Y toner.

The Y developer that has passed the development area according to the rotation of the developing sleeve 24Y is affected by a repulsion magnetic field formed by repulsion magnetic poles included in the not-shown magnet roller and is removed from the developing sleeve 24Y to return to the inside of the developer carrying device 22.

The developer carrying device 22Y includes a first screw member 26Y, a second screw member 32Y, a partition wall interposed between the first and second screw members, and a toner concentration sensor 45Y including a permeability sensor. The partition wall partitions a first carrying chamber as a developer carrying unit in which the first screw member 26Y is housed and a second carrying chamber as a developer carrying unit in which the second screw member 32Y is housed. In areas opposed to both the ends in axial directions of both the screw members 26Y and 32Y, both the carrying chambers communicate with each other through not-shown openings, respectively.

The first screw member 26Y and the second screw member 32Y as agitating and carrying members have rod-like rotation shaft members, both the ends of which are rotatably supported by not-shown bearings, respectively, and spiral blades protrudingly provided on peripheral surfaces of the rotation shaft members. When the first screw member 26Y and the second screw member 32Y are driven to rotate by a not-shown driving unit, the first screw member 26Y and the second screw member 32Y carry the Y developer in the rotation axis direction with the spiral blades.

In the first carrying chamber in which the first screw member 26Y is housed, according to the rotation of the first screw member 26Y, the Y developer is carried from the front side to the inner side in a direction orthogonal to the surface of the figure. When the Y developer is carried to near the end on the inner side of the casing 21Y, the Y developer enters the second carrying chamber through a not-shown opening provided in the partition wall.

The developing unit 23Y is formed above the second carrying chamber in which the second screw member 32Y is housed. The second carrying chamber and the developing unit 23Y communicate with each other in the entire area of sections thereof opposed to each other. The second screw member 32Y and the developing sleeve 24Y disposed obliquely above the second screw member 32Y are opposed to each other while maintaining a parallel relation. In the second carrying chamber, the Y developer is conveyed from the inner side to the front side in the direction orthogonal to the surface of the figure. In a process of this conveyance, the Y developer around the rotating direction of the second screw member 32Y is drawn up to the developing sleeve 24Y as appropriate and the Y developer after development is collected from the developing sleeve 24Y as appropriate. The Y developer carried to near the end on the front side in the figure of the second carrying chamber returns to the inside of the first carrying chamber through the not-shown opening provided in the partition wall.

The toner concentration sensor 45Y as the toner-concentration detecting unit including the permeability sensor is fixed to the lower wall of the first carrying chamber. The toner concentration sensor 45Y detects, from below the first screw member 26Y, a toner concentration of the Y developer carried by the first screw member 26Y and outputs a voltage corresponding to a result of the detection. A not-shown control unit drives a not-shown Y toner supplying device as required based on an output voltage value from the toner concentration sensor 45Y to supply an appropriate quantity of the Y toner into the first carrying chamber. Consequently, a toner concentration of the Y developer reduced by the development is recovered.

A Y toner image formed on the photosensitive member 11Y is primarily transferred onto the intermediate transfer belt 51 in a primary transfer nip for Y described later. A transfer residual toner not primarily transferred onto the intermediate transfer belt 51 adheres to the surface of the photosensitive member 11Y that has undergone this primary transfer process.

The drum cleaning device 14Y cantilevers a cleaning blade 15Y made of, for example, polyurethane rubber and sets a free end side thereof in contact with the surface of the photosensitive member 11Y. The drum cleaning device 14Y sets a brush tip side of a brush roller 16Y, which includes rotation shaft members driven to rotate by a not-shown driving unit and innumerable conductive raisings vertically provided on peripheral surfaces of the rotation shaft members, in contact with the photosensitive member 11Y. The drum cleaning device 14Y scrapes off the transfer residual toner from the surface of the photosensitive member 11Y with the cleaning blade 15Y and the brush roller 16Y. A cleaning bias is applied to the brush roller 16Y via an electric field roller 17Y of metal, which comes into contact with the brush roller 16Y. The tip of a scraper 18Y is pressed against the electric field roller 17Y. The transfer residual toner scraped off from the photosensitive member 11Y by the cleaning blade 15Y and the brush roller 16Y passes through the brush roller 16Y and the electric field roller 17Y and is then scraped off from the electric field roller 17Y by the scraper 18Y to fall onto a collection screw 18Y. The transfer residual toner is discharged to the outside of the casing according to the rotation of the collection screw 18Y and the returned into the developer carrying device 22 via a not-shown toner recycle carrying unit.

The surface of the photosensitive member 11Y, from which the transfer residual toner is cleaned by the drum cleaning device 14Y, is subjected to charge removal by the charge removing device 13Y including a charge removing lamp and then uniformly charged by the charging member 12Y again.

The potential of the non-image section of the photosensitive member 11Y, which has passed a position of optical writing by writing light L, is detected by the Y-potential sensor 49Y and a result of the detection is sent to the not-shown control unit.

The photosensitive member 11Y having a diameter of 60 [mm] is driven to rotate at linear speed of 282 [mm/sec]. The developing sleeve 24Y having a diameter of 25 [mm] is driven to rotate at linear speed of 564 [mm/sec]. An amount of a toner in a developer supplied to the development area is in a range of about −10 [μC/g] to −30 [μC/g]. A development gap, which is a gap between the photosensitive member 11Y and the developing sleeve 24Y, is set in a range of 0.5 mm to 0.3 mm. The thickness of a photosensitive layer of the photosensitive member 11Y is 30 [μm]. A beam spot diameter on the photosensitive member 11Y of the writing light L is 50×60 [μm]. A quantity of light of the writing light L is about 0.47 [mW]. A uniformly charged potential of the photosensitive member 11Y is, for example, −700 [V] and the potential of an electrostatic latent image is −120 [V]. Moreover, a voltage of a developing bias is, for example, −470 [V] and a development potential of 350 [V] is secured.

The process unit 10Y has been described in detail. The process units of the other colors (10C, 10M, and 10K) are the same as the process unit 10Y except that colors of toners used therein are different.

As shown in FIG. 2, the photosensitive members 11Y, 11C, 11M, and 11K of the process units 10Y, 10C, 10M, and 10K rotate while coming into contact with the upper stretch surface of the intermediate transfer belt 51 endlessly moved in the clockwise direction and form primary transfer nips for Y, C, M, and K. On the rear sides of the primary transfer nips for Y, C, M, and K, the primary transfer rollers 55Y, 55C, 55M, and 55K are in contact with the rear surface of the intermediate transfer belt 51. Primary transfer biases having a polarity opposite to the charging polarity of the toner are applied to the primary transfer rollers 55Y, 55C, 55M, and 55K by not-shown bias supplying units, respectively. Primary transfer fields for electrostatically moving the toner from the photosensitive member side to the belt side are formed in the primary transfer nips for Y, C, M, and K by the primary transfer biases. Y, C, M, and K toner images formed on the photosensitive members 11Y, 11C, 11M, and 11K enter the primary transfer nips for Y, C, M, and K according to the rotation of the photosensitive members 11Y, 11C, 11M, and 11K. The Y, C, M, and K toner images are sequentially superimposed one another and primarily transferred onto the intermediate transfer belt 51 by the primary transfer fields and an action of a nip pressure. Consequently, a four-color superimposed toner image (hereinafter, "four-color toner image") is formed on the front surface (a loop outer peripheral surface) of the intermediate transfer belt 51. Conductive brushes to which the primary transfer biases are applied, a no-contact corona charger, or the like can be adopted instead of the primary transfer rollers 55Y, 55C, 55M, and 55K.

Figure 4:
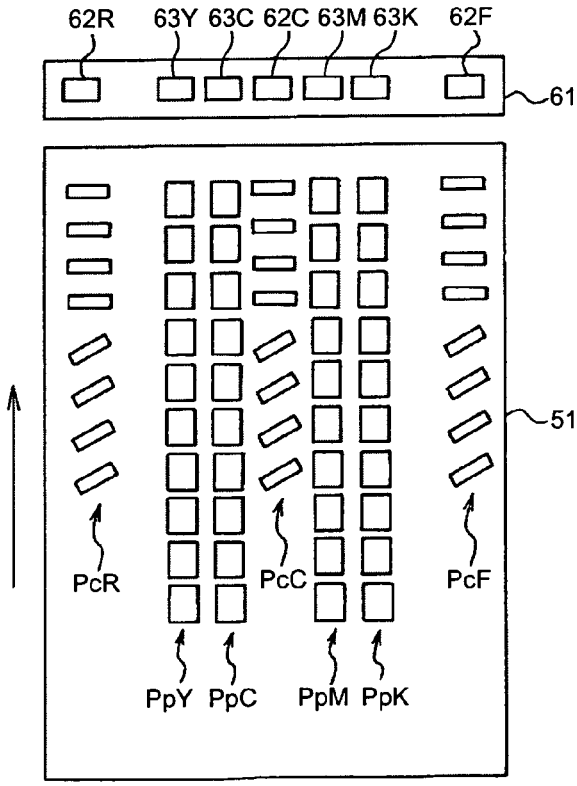
FIG. 4 is a schematic view for explaining an arrangement of an optical sensor unit and the intermediate transfer belt shown in FIG. 2.

On the right side in the figure of the process unit 10K, an optical sensor unit 61 is disposed to be opposed to the front surface of the intermediate transfer belt 51 via a predetermined gap. The optical sensor unit 61 includes, as shown in FIG. 4, a rear side position sensor 62R, a Y image concentration sensor 63Y, a C image concentration sensor 63C, a center position sensor 62*c*, an M image concentration sensor 63M, a K image concentration sensor 63K, and a front side position sensor 62F arranged in the width direction of the intermediate transfer belt 51. All of these sensors include reflection photosensors. The sensors reflect light emitted from a not-shown light-emitting element on the front surface of the intermediate transfer belt 51 and a toner image on the belt and detects an amount of reflected light with a not-shown light-receiving element. The not-shown control unit can detect the toner image on the intermediate transfer belt 51 and detect a concentration of the image (a toner deposit amount per unit area) based on output voltage values from the sensors.

As shown in FIG. 3, a secondary transfer roller 56 is disposed below the intermediate transfer belt 51. The secondary transfer roller 56 comes into contact with the front surface of the intermediate transfer belt 51 and forms a secondary transfer nip while being driven to rotate counterclockwise in the figure by a not-shown driving unit. On the rear side of the secondary transfer nip, the intermediate transfer belt 51 is wound around the secondary transfer backup roller 53, which is electrically grounded.

The secondary transfer bias having a polarity opposite to a charging polarity of a toner is applied to the secondary transfer roller 56 by the not-shown bias supplying unit to form a secondary transfer field between the secondary transfer roller 56 and the grounded secondary transfer backup roller 53. The four-color toner image formed on the front surface of the intermediate transfer belt 51 enters the secondary transfer nip according to the endless movement of the intermediate transfer belt 51.

In FIG. 1, in the sheet feeding device 200, a plurality of sheet feeding cassettes 201 that store recording sheets P, a plurality of sheet feeding rollers 202 that deliver the recording sheets P stored in the sheet feeding cassettes 201 to the outside of the cassettes, a plurality of separation roller pairs 203 that separate the delivered recording sheets P one by one, a plurality of conveying roller pairs 205 that convey the recording sheet P after the separation along a delivering path 204, and the like are disposed. The sheet feeding device 200 is disposed right below the printer unit 1 as shown in the figure. The delivering path 204 of the sheet feeding device 200 is connected to a sheet feeding path 70 of the printer unit 1. Consequently, the recording sheets P delivered from the sheet feeding cassettes 201 of the sheet feeding device 200 are fed into the sheet feeding path 70 of the printer unit 1 through the delivering path 204.

A registration roller pair 71 is disposed near the end of the sheet feeding path 70 of the printer unit 1. The registration roller pair 71 delivers the recording sheet P nipped between the rollers to the secondary transfer nip at timing when the recording sheet P is synchronized with the four-color toner image on the intermediate transfer belt 51. In the secondary transfer nip, the four-color toner image on the intermediate transfer belt 51 is secondarily transferred onto the recording sheet P collectively by the influence of a secondary transfer field and a nip pressure. The four-color toner image forms a full color image in conjunction with the while color of the recording sheet P. The recording sheet P on which the full color image is formed in this way is discharged from the secondary nip and separated from the intermediate transfer belt 51.

On the left side in the figure of the secondary transfer nip, a conveyor belt unit 75 that endlessly moves an endless sheet conveyor belt 76 in a counterclockwise direction in the figure while stretching the endless sheet conveyor belt 76 with a plurality of stretch rollers is disposed. The recording sheet P separated from the intermediate transfer belt 51 is passed onto an upper stretch surface of the endless sheet conveyor belt 76 and conveyed to a fixing device 80.

The recording sheet P sent into the fixing device 80 is nipped in a fixing nip formed by a heating roller 81 including a not-shown heat generation source such as a halogen lamp and a pressure roller 82 that is pressed against the heating roller 81. The recording sheet P is heated while being pressed and is sent to the outside of the fixing device 80 while having the full color image fixed on the surface thereof.

A slight quantity of secondary transfer residual toner not transferred onto the recording sheet P adheres to the surface of the intermediate transfer belt 51 after passing through the secondary transfer nip. The secondary transfer residual toner is removed from the intermediate transfer belt 51 by a belt cleaning device 57 that is in contact with the front surface of the intermediate transfer belt 51.

As shown in FIG. 1, a switch-back device 85 is disposed below the fixing device 80. When the recording sheet P discharged from the fixing device 80 comes to a conveying path switching position for switching by a swingable switching pawl, the recording sheet P is sent to a sheet discharge roller pair 87 or the switch-back device 85 according to a swing stop position of the switching pawl 86. When the recording sheet P is sent to the sheet discharge roller pair 87, after being discharged to the outside of the apparatus, the recording sheet P is stacked on the sheet discharge tray 3.

On the other hand, when the recording sheet P is sent to the switch-back device 85, after being reversed by switch-back conveyance by the switch-back device 85, the recording sheet P is conveyed to the registration roller pair 71 again. The recording sheet P enters the secondary transfer nip again and a full color image is formed on the other surface.

The recording sheet P manually fed on the manual feed tray 2 provided on the side of the housing of the printer unit 1 is fed to the registration roller pair 71 after passing through a manual feed roller 72 and a manual feed separation roller pair 73. The registration roller pair 71 may be grounded or may be applied with a bias to remove paper powder of the recording sheet P.

When a user takes a copy of an original with the copying machine according to this embodiment, first, the user sets the original on an original stand 401 of the original automatic document feeder 400. Alternatively, the user opens the original automatic document feeder 400, sets the original on the contact glass 301 of the scanner 300, and closes the original automatic document feeder 400 to press the original. Thereafter, when the user presses a start switch (not-shown), when the original is set on the original automatic document feeder 400, the original is fed to the contact glass 301. The scanner 300 drives to start scanning by the first traveling member 303 and the second traveling member 304. At substantially the same time, driving of the transfer unit 50 and the respective color process units 10Y, 10C, 10M, and 10K is started. Delivery of the recording sheet P from the sheet feeding device 200 is also started. When the recording sheet P not set in the sheet feeding cassettes 201 is used, delivery of the recording sheet P set on the manual feed tray 2 is performed.

Figure 5:
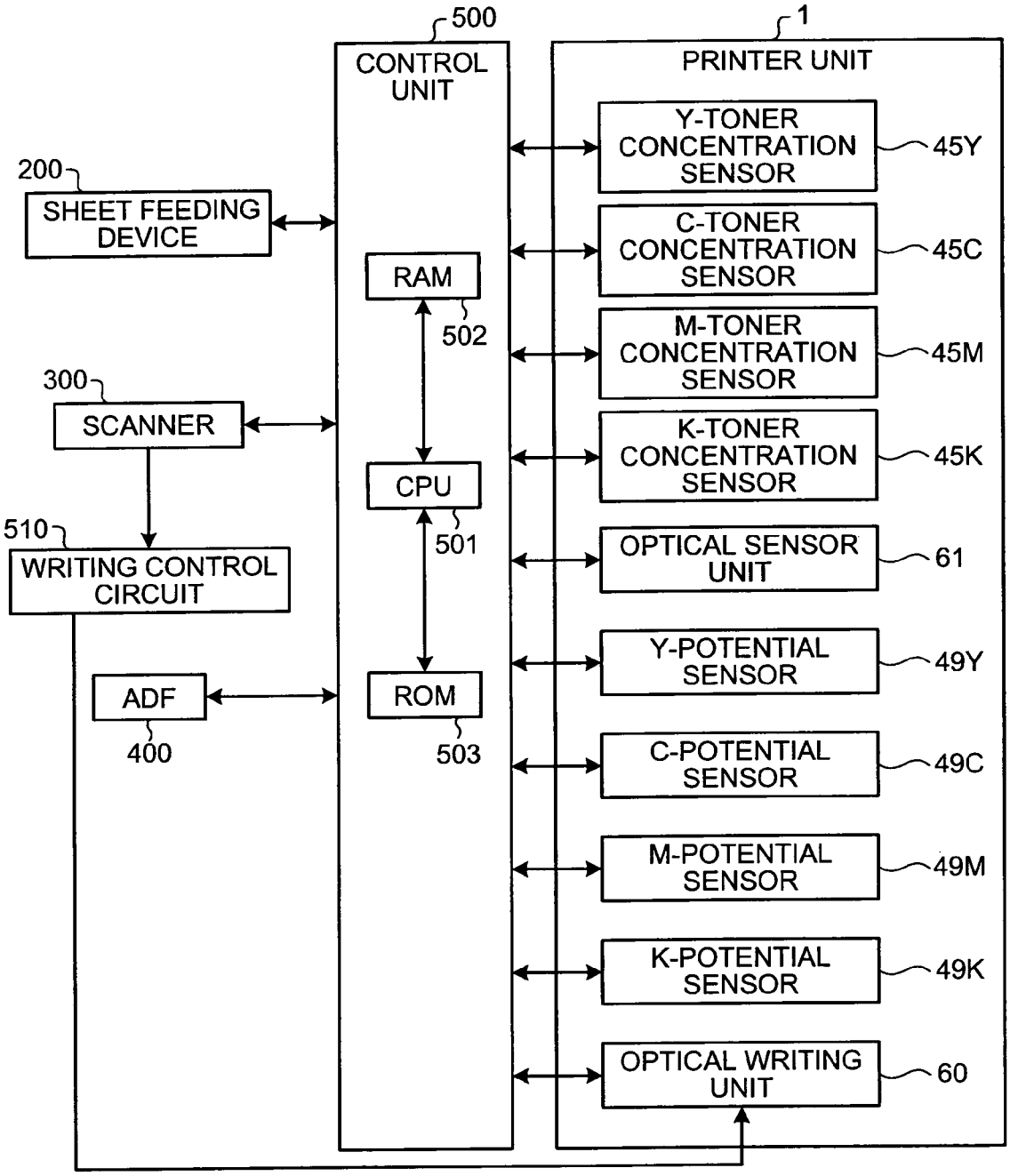
FIG. 5 is a block diagram of the copying machine shown in FIG. 1.

FIG. 5 is a block diagram of the copying machine shown in FIG. 1. The copying machine includes a control unit 500 that manages control of various devices. In the control unit 500, a read only memory (ROM) 503 that stores therein stationary data such as a computer program in advance and a random access memory (RAM) 502 that functions as a work area or the like for rewritably storing various data are connected via a bus line to a central processing unit (CPU) 501 that executes control of various arithmetic operations and driving of respective units. The ROM 503 also stores therein a concentration conversion data table indicating a relation between output voltage values from image concentration sensors of the respective colors (63Y, 63C, 63M, and 63K in FIG. 4) in the optical sensor unit 61 and image densities corresponding to the output voltage values.

The printer unit 1, the sheet feeding device 200, the scanner 300, and the ADF 400 are connected to the control unit 500. For convenience of illustration, only a few sensors and the optical writing unit 60 are shown as devices in the printer unit 1. In other words, the control unit 500 controls other devices (e.g., a transfer unit and various color process units) that are not shown in FIG. 5. Signals output from each of the sensors are sent to the control unit 500.

Figure 6:
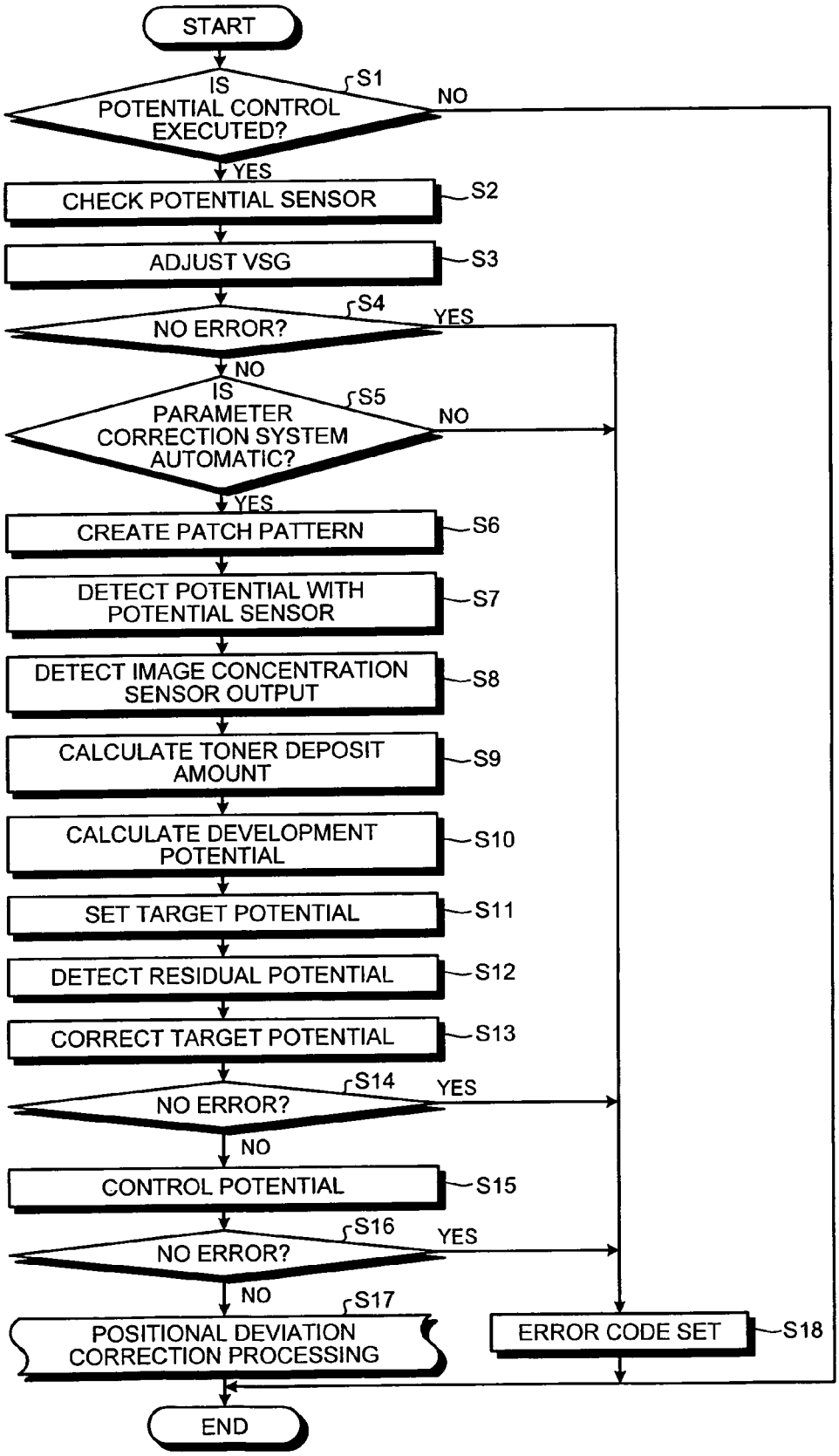
FIG. 6 is a flowchart of a parameter correction processing carried out by a control unit shown in FIG. 5.

FIG. 6 is a flowchart of a parameter correction processing carried out by the control unit 500. The parameter correction processing is carried out at predetermined timing, such as during start of the copying machine, every time the number of copies decided in advance is taken (between a preceding print operation and a flowing print operation in a continuous print operation), or every fixed time. In FIG. 6, a processing flow during start of the copying machine is shown.

When the parameter correction processing is started, first, to distinguish timing for turning on a power supply from timing for abnormal processing for jam or the like, a heating roller surface temperature (hereinafter, "fixing temperature") in the fixing device 80 is detected as a condition for executing the processing flow. It is judged whether the fixing temperature exceeds 100 [° C.]. When the fixing temperature exceeds 100 [° C.] (NO at step S1), the control unit 500 regards that it is not the time for turning on the power supply and finishes the processing flow.

When the fixing temperature does not exceed 100 [° C.] (YES at step S1), the control unit 500 performs potential sensor check (step S2). In this potential sensor check, the control unit 500 uniformly charges, in the process units of the respective colors 10Y to 10K, the surfaces of the photosensitive members 11Y to 11K under a predetermined condition and detects surface potentials of the photosensitive members 11Y to 11K with the potential sensor (e.g., 49Y in FIG. 3). Thereafter, the control unit 500 performs Vsg adjustment or the optical sensor unit (61 in FIG. 4) (step S3). In this Vsg adjustment, the control unit 500 adjusts, for the respective sensors 62R, 62C, 62F, 63Y, 63C, 63M, and 63K, an amount of light emission from a light-emitting element to fix an output voltage (Vsg) from a light-receiving element that detects reflected light to the non-image area of the intermediate transfer belt 51. At steps S2 to S3, the control unit 500 performs the potential sensor check and the Vsg adjustment for the respective colors in parallel.

When the Vsg adjustment is finished, the control unit 500 judges whether there is an error in the potential sensor check (step S2) and the Vsg adjustment (steps S3 and S4). When there is an error (NO at S4), after setting an error code corresponding to the error (step S18), the control unit 500 finishes the operation. On the other hand, when there is no error (YES at S4), the control unit 500 judges whether a parameter correction system is automatically set (step S5). The control unit 500 executes the processing at steps S3 to S4 regardless of the parameter correction system.

When the parameter correction system is not automatically set (parameters are set to fixed values) (NO at S5), after setting the error code, the control unit 500 finishes the series of control flows. On the other hand, when the parameter correction system is automatically set (YES at S5), the control unit 500 executes a flow at steps S6 to S16 described later.

At step S6, the control unit 500 forms seven sets of toner patch patterns including a plurality of reference toner images shown in FIG. 4 on the front surface of the intermediate transfer belt 51. These toner patch patterns are formed side by side in the width direction of the intermediate transfer belt 51 to be detected by any one of the seven sensors 62R, 62C, 62F, 63Y, 63C, 63M, and 63K included in the optical sensor unit 61. These seven sets of toner patch patterns are roughly divided into patch patterns for concentration gradation detection and patch patterns for positional deviation detection.

Figure 7:
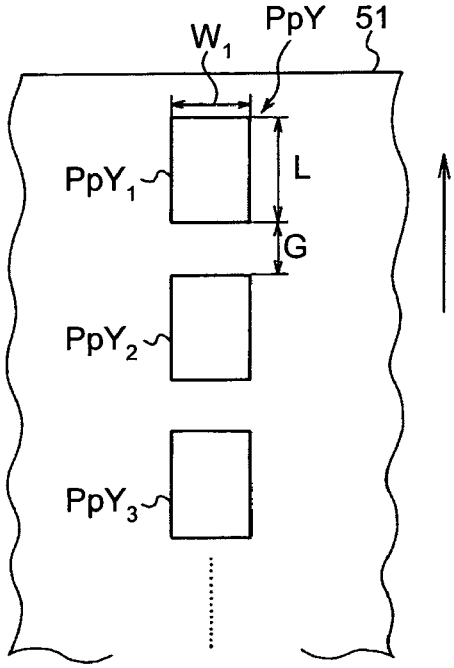
FIG. 7 is an enlarged plan view of a patch pattern for Y concentration gradation detection and the intermediate transfer belt.

As the patch patterns for concentration gradation detection, patch patterns for Y, C, M, and K concentration gradation detection PpY, PpC, PpM, and PpK including a plurality of same color reference toner images (Y, C, M, or K reference toner images) having different image densities are individually formed and detected by the Y, C, M, and K image concentration sensors 63Y, 63C, 63M, and 63K. Referring to the patch pattern PpY for Y concentration gradation detection as an example, as shown in FIG. 7, the patch pattern PpY includes n Y reference toner images, i.e., a first Y reference toner image PpY1, a second Y reference toner image PpY2, . . . , and an nth reference toner image PpYn, arranged at predetermined intervals G in a belt moving direction (an arrow direction in the figure). These reference toner images have different image densities but have the same shape and posture on the intermediate transfer belt 51. The reference toner images have a rectangular shape with the width direction thereof set along the belt width direction and the length direction thereof set along the belt moving direction. Width W1 thereof is 15 [mm] and length L1 thereof is 20 [mm]. The interval G is 10 [mm]. An interval in the belt width direction in patch patterns of different colors is 5 [mm].

The respective reference toner images in these patch patterns for concentration gradation detection PpY, PpC, PpM, and PpK are toner images formed on the photosensitive members 11Y, 11C, 11M, and 11K of the respective process units 10Y, 10C, 10M, and 10K and transferred onto the intermediate transfer belt 51. When the reference toner images pass right below the image concentration sensors 63Y, 63C, 63M, and 63K according to the endless movement of the intermediate transfer belt 51, the reference toner images reflect light emitted from the sensors on the surfaces thereof. Amounts of the reflected light take values correlated to image densities of the reference toner images. The control unit 500 stores, for each of the colors, sensor output voltage values for the respective reference toner images in the RAM 502 as Vpi (i=1 to N) (step S8). After specifying image densities (toner deposit amounts per unit area) of the respective reference toner images based on the sensor output voltage values and the concentration conversion data table stored in the ROM 503 in advance, the control unit 500 stores a specified result in the RAM 502 (step S9). Before the patch patterns for concentration gradation detection for the respective colors are developed on the photosensitive members of the respective colors, potentials of respective reference latent images as precursors of the respective reference toner images are detected by the potential sensors. The control unit 500 sequentially stores results of the detection in the RAM 502 (step S7).

Figure 8:
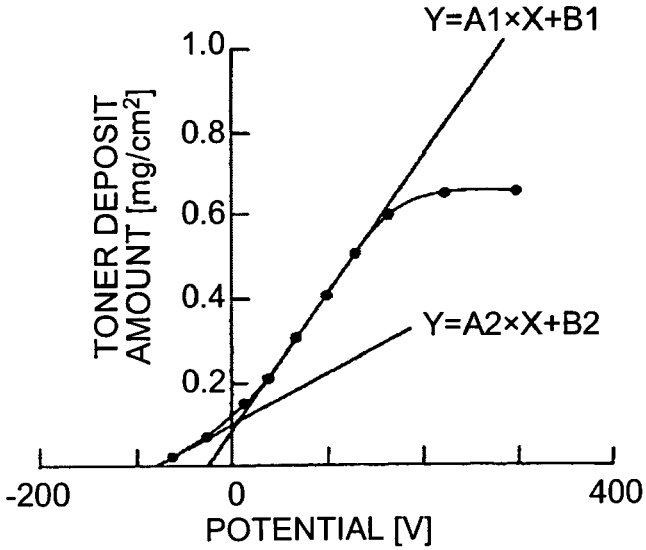
FIG. 8 is a graph of a relation between a toner deposit amount and potential.

When the toner deposit amounts for the reference toner images of the respective colors are specified, the control unit 500 calculates appropriate development potentials for the developing devices of the respective colors (step S10). Specifically, for example, a relation between the potentials of the respective reference latent images obtained at S7 and the toner deposit amounts obtained at S9 are plotted on an X-Y plane as shown in FIG. 8. In the figure, the X axis indicates a potential (a difference between a development bias VB and a latent image potential) and the Y axis indicates a toner deposit amount per unit area [mg/cm$^2$]. As described above, the reflection photosensors are used as the respective sensors of the optical sensor unit 61. Output voltage values from the sensors are saturated when a toner deposit amount on a reference toner image is considerably large. Therefore, when a toner deposit amount is calculated using a sensor output voltage value for a reference toner image having a relatively large toner deposit amount, an error occurs. Thus, as shown in FIG. 9, only a data combination in a section in which a relation between the potential of a reference latent image and a toner deposit amount is linear is selected among a plurality of data combinations including potentials of reference latent images and toner deposit amounts for reference toner images. Linear approximation of a development characteristic is obtained by applying the method of least squares to the data in this section. A development potential for each of the colors is calculated based on an approximate linear equation (E) obtained for each of the colors. Although the reflection photosensors of the regular reflection type are used in this copying machine, reflection photosensors of the diffuse reflection type can be used.

The following equations are used in the calculation by the method of least squares:

$$Xave=\Sigma Xn/k \quad (1)$$

$$Yave=\Sigma Yn/k \quad (2)$$

$$Sx=\Sigma(Xn-Xave)\times(Xn-Xave) \quad (3)$$

$$Sy=\Sigma(Yn-Yave)\times(Yn-Yave) \quad (4)$$

$$Sxy=\Sigma(Xn-Xave)\times(Yn-Yave) \quad (5)$$

When the approximate linear equation (E) obtained from the output values from the potential sensors of the respective colors (the potentials of the reference latent images of the respective colors) and the toner deposit amounts (the image densities) for the respective reference toner images is Y=A1×X+B1, coefficients A1 and B1 can be represented as follows:

$$A1=Sxy/Sx \quad (6)$$

$$B1=Yave-A1\times Xave \quad (7)$$

A correlation coefficient R of the approximate linear equation (E) can be represented as follows:

$$R\times R=(Sxy\times Sxy)/(Sx\times Sy) \quad (8)$$

Among potential data Xn and toner deposit amount data Yn after visualization obtained from the potentials of the reference latent images and the toner deposit amounts for each of the colors, which are calculated up to S9, the following six sets of data having smaller numerical values are selected:

(X1 to X5, Y1 to Y5)
(X2 to X6, Y2 to Y6)
(X3 to X7, Y3 to Y7)
(X4 to X8, Y4 to Y8)
(X5 to X9, Y5 to Y9)
(X6 to X10, Y6 to Y10)

Linear approximation calculation is performed according to Equations (1) to (8) and the correlation coefficient R is calculated to obtain the following six sets of approximate linear equations and correlation coefficients (9) to (14):

$$Y11=A11\times X+B11;R11 \quad (9)$$

$$Y12=A12\times X+B12;R12 \quad (10)$$

$$Y13=A13\times X+B13;R13 \quad (11)$$

$$Y14=A14\times X+B14;R14 \quad (12)$$

$$Y15=A15\times X+B15;R15 \quad (13)$$

$$Y16=A16\times X+B16;R16 \quad (14)$$

One approximate linear equation corresponding to a maximum value among the correlation coefficients R11 to R16 is selected as the approximate linear equation (E) out of the obtained six approximate linear equations.

In the approximate linear equation (E), a value of X at the time when a value of Y is a necessary maximum toner deposit amount Max as shown in FIG. 9, i.e., a value Vmax of a development potential is calculated. A development bias potential VB in each of the developing devices of the respective colors and an appropriate latent image potential (a potential of an exposing unit) VL corresponding to the development bias potential VB are given by the following Equations (15) and (16) from the equations described above:

$$V\max=(M\max-B1)/A1 \quad (15)$$

$$VB-VL=V\max=(M\max-B1)/A1 \quad (16)$$

A relation between VB and VL can be represented using the coefficients of the approximate linear equation (E). Therefore, Equation (16) is represented as follows:

$$M\max=A1\times V\max+B1 \quad (17)$$

A relation between a background potential VD, which is potential before exposure of the photosensitive members, and the development bias potential VB is given from an X coordinate VK (a development start voltage of the developing device) at an intersection point of a linear equation shown in FIG. 9, i.e., $$Y=A2*X+B2 \quad (18)$$

and the X axis and a background smear margin voltage Vα, which is experimentally obtained:

$$VD-VB=VK+V\alpha \quad (19)$$

Therefore, a relation among Vmax, VD, VB, and VL depends on Equations (16) and (19). In this example, with Vmax as a reference value, a relation between the reference value and the respective voltages VD, VB, and VL is obtained by an experiment and the like in advance and stored in the ROM 503 as a potential control table as shown in FIG. 10.

The control unit 500 selects Vmax closest to Vmax calculated for each of the colors from the potential control table and sets the respective control voltages (potentials) VB, VD, and VL corresponding to the selected Vmax as target potentials (step S11).

Thereafter, the control unit 500 controls laser emission power of the semiconductor lasers of the optical writing unit 60 to be a maximum amount of light via a writing control circuit 510 and captures an output value of the potential sensor to thereby detect a residual potential on the photosensitive members (step S12). When the residual potential is not 0 [V], the control unit 500 corrects the target potentials VB, VD, and VL determined at step S11 by an amount of the residual potential to set target potentials.

The control unit 500 judges whether there is no error at steps S5 to S13 (step S14). When there is an error even in one color (NO at S14), the control unit 500 sets an error code because image concentration fluctuation is large and processing after this is useless even if only the other colors are controlled (step S18) and finishes the series of control flows. The control unit 500 does not update image creation conditions and creates an image under image creation conditions same as those of the last time until the next parameter correction processing is successful.

When it is judged at S14 that there is no error (Y), the control unit 500 adjusts a power supply circuit (not shown) such that the background potential VD of the photosensitive members of the respective colors reach the target potential. The control unit 500 adjusts laser light power in the semiconductor lasers via a laser control unit (not shown) such that the surface potential VL of the photosensitive members reaches the target potential. The control unit 500 adjusts the power supply circuit such that the development bias potential VB reaches the target potential in the developing devices of the respective colors (step S15).

The control unit 500 judges whether there is an error at S15 (step S16). When there is no error (YES at S16), after performing positional deviation correction processing described later, the control unit 500 finishes the series of control processing. On the other hand, when there is an error (NO at S16), the control unit 500 finishes the series of control flows after setting an error code.

As patch patterns for positional deviation detection, as shown in FIG. 4, the three sets of patch patterns, i.e., the patch patterns for rear side positional deviation PcR formed near one end in the width direction of the intermediate transfer belt 51, patch patterns for center positional deviation detection PcC formed in the center in the width direction, and patch patterns for front side positional deviation detection PcF formed near the other end in the width direction are formed. All of the patch patterns include a plurality of reference toner images arranged in the belt moving direction. Each of the three sets of patch patterns has reference toner images of four colors, Y, C, M, and K. If no positional deviation occurs in the photosensitive members and an exposure optical system in each of the rear side, the center, and the front side, reference toner images of the respective colors are formed at equal intervals and in equal postures. However, when positional deviation occurs, formation intervals vary and postures tilt. Therefore, in the positional deviation correction processing (step S17), the control unit 500 detects irregularity of the formation intervals and the postures based on detection time intervals of the respective reference toner images. The control unit 500 adjusts, based on a result of the detection, the tilt of a mirror of the exposure optical system using a not-shown tilt correcting mechanism and corrects exposure start timing. Consequently, positional deviation of the toner images of the respective colors is reduced.

Figure 12:
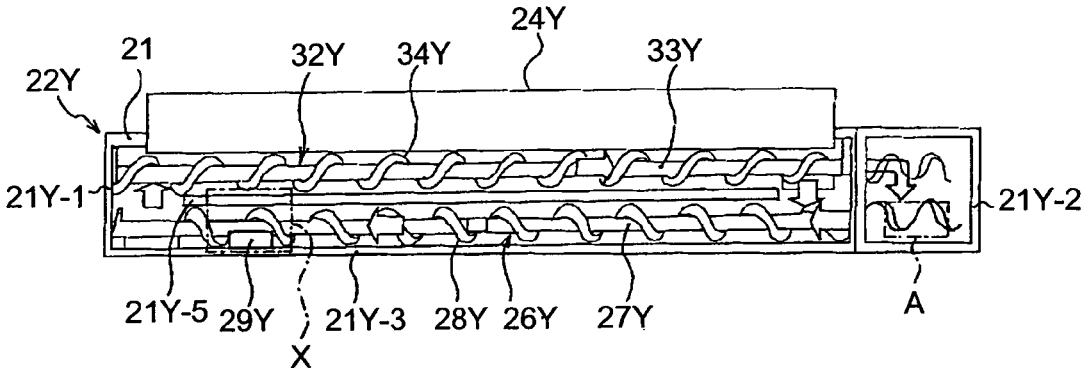
FIG. 12 is a disassembled plan view of the developing device for Y shown in FIG. 11 viewed from above.

FIG. 11 is a disassembled perspective view of the developing device 20Y for Y. FIG. 12 is a disassembled plan view of the developing device 20Y viewed from above. As described above, the developing device 20Y includes the developing unit 23Y including the developing sleeve 24Y and the developer carrying device 22Y that agitates and carries the Y developer. The developer carrying device 22Y includes a first carrying chamber that houses the first screw member 26Y as the agitating and carrying member and the second carrying chamber that houses the second screw member 32Y as the agitating and carrying member. The first screw member 26Y includes a rotation shaft member 27Y, both ends in an axial direction of which are rotatably supported by bearings, and a spiral blade 28Y protrudingly provided in a spiral shape on a peripheral surface of the rotation shaft member 27Y. The second screw member 32Y includes a rotation shaft member 33Y, both ends in an axial direction of which are rotatably supported by bearings, and a spiral blade 34Y protrudingly provided in a spiral shape on a peripheral surface of the rotation shaft member 33Y.

The first screw member 26Y in the first carrying chamber as the developer carrying unit is surrounded by a wall of the casing around sides thereof. On two sides located on both sides in the axial direction of the first screw member 26Y, a rear side plate 21Y-1 and a front side plate 21Y-2 of the casing surround the first screw member 26Y from both sides in the axial direction. On one of two sides located on both sides in a direction orthogonal to the axial direction of the first screw member 26Y, a left side plate 21Y-3 of the casing as the sidewall extends in the rotation axis direction of the first screw member 26Y while being opposed to the first screw member 26Y via a predetermined gap. On the other of the two sides, a partition wall 21Y-5 as a sidewall that partitions the first carrying chamber and the second carrying chamber extends in the rotation axis direction of the first screw member 26Y while being opposed to the first screw member 26Y via a predetermined gap.

The second screw member 32Y in the second carrying chamber as the developer carrying unit is also surrounded by the wall of the casing around sides thereof. On two sides located on both sides in the axial direction of the second screw member 32Y, the rear side plate 21Y-1 and the front side plate 21Y-2 of the casing surround the second screw member 32Y from both sides in the axial direction. On one of two sides located on both sides in a direction orthogonal to the axial direction of the second screw member 32Y, a right side plate 21Y-4 of the casing as the sidewall extends in the rotation axis direction of the second screw member 32Y while being opposed to the second screw member 32Y via a predetermined gap. On the other of the two sides, the partition wall 21Y-5 that partitions the first carrying chamber and the second carrying chamber extends in the rotation axis direction of the second screw member 32Y while being opposed to the second screw member 32Y via a predetermined gap.

The second screw member 32Y, the sides of which are surrounded by the wall, carries the not-shown Y developer stored in the spiral blade 34Y in the rotation axis direction from the left side to the right side in FIG. 12 while agitating the Y developer in the rotating direction according to the rotation drive. Because the second screw member 32Y and the developing sleeve 24Y are disposed in parallel to each other, a carrying direction of the Y developer is a direction along the rotation axis direction of the developing sleeve 24Y. The second screw member 32Y supplies the Y developer to the surface of the developing sleeve 24Y in the axial direction thereof.

The Y developer carried to near the right side end in the figure of the second screw member 32Y enters the first carrying chamber through an opening provided in the partition wall 21Y-5 and then is stored in the spiral blade 28Y of the first screw member 26Y. According to the rotation drive of the first screw member 26Y, the Y developer is carried along the rotation axis direction of the first screw member 26Y from the right side to the left side in the figure while being agitated in the rotating direction.

In the first carrying chamber, in a part of an area in which the first screw member 26Y is surrounded by the left side plate 21Y-3 and the partition wall 21Y-5 of the casing, the Y toner concentration sensor 45Y is fixed to the lower wall of the casing. The Y toner concentration sensor 45Y detects, from below the first screw member 26Y, the permeability of the Y developer carried along the rotation axis direction by the first screw member 26Y and outputs a voltage of a value corresponding to a result of the detection to the control unit 500. Because the permeability of the Y developer has a correlation with the Y toner concentration of the Y developer, the control unit 500 grasps the Y toner concentration based on the output voltage value from the Y toner concentration sensor 45Y.

The printer unit 1 includes not-shown Y, C, M, and K toner supplying units for individually supplying the Y, C, M, and K toners into the Y, C, M, and K developing devices. The control unit 500 stores Vtref for Y, C, M, and K, which indicates target values of output voltage values from the Y, C, M, and K toner concentration sensors 45Y, 45C, 45M, and 45K, in the RAM 502. When differences between the output voltage values from the Y, C, M, and K toner concentration sensors and Vtref for Y, C, M, and K exceed a predetermined value, the Y, C, M, and K toner supplying units are driven for times corresponding to the differences. Consequently, the Y, C, M, and K toners are supplied from a toner supply port (e.g., A in FIG. 12) provided on a most upstream side in the first carrying chamber in the Y, C, M, and K developing devices into the first carrying chamber. Y, C, M, and K toner densities of the Y, C, M, and K developers are maintained in a fixed range.

The permeability of a developer shows a satisfactory correlation with a bulk volume of the developer. The bulk volume of the developer fluctuates because of an unattended state of the developer even if a toner concentration of the developer is fixed. For example, the developer unattended for a long time in a state in which the developer is not agitated by the screw members in the first carrying chamber and the second carrying chamber emits the air among toner particles and carriers because of an own weight of the developer. An amount of charge of the toner particles is reduced. Thus, a bulk volume of the toner is gradually increased as the unattended time passes. According to the increase in the bulk volume, the permeability is gradually increased. When the toner is unattended for a long period, the increases in the bulk volume and the permeability are saturated. In such a saturated state, a distance among the magnetic carriers is small compared with that in the developer during image creation (during agitation). Therefore, the fall in a toner concentration from an original value is misdetected.

Figure 13:
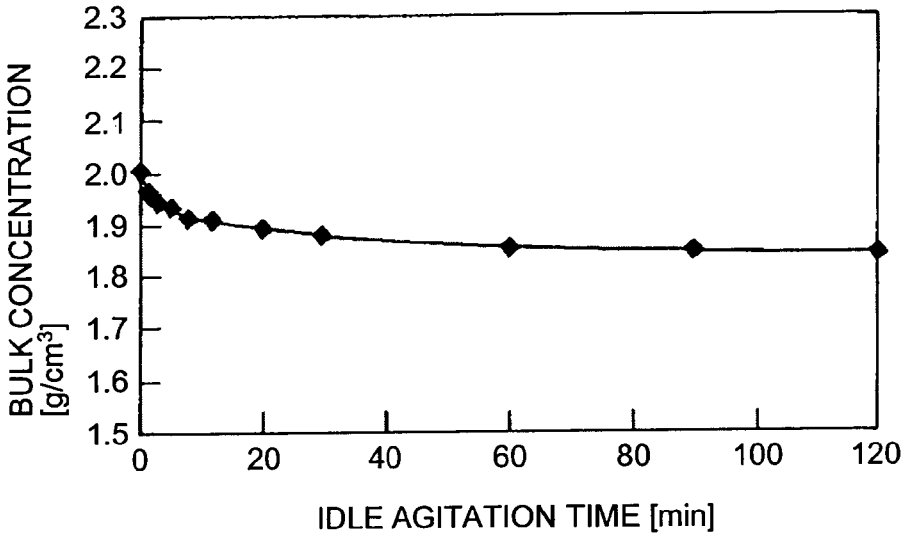
FIG. 13 is a graph of a relation between bulk volume and idle agitation time of a developer.
Figure 14:
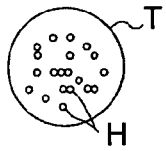
FIG. 14 is an enlarged schematic diagram of toner particles in a default state.
Figure 15:
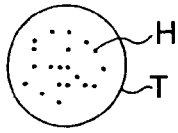
FIG. 15 is an enlarged schematic diagram of toner particles after the developer was idly agitated for 30 minutes.

On the other hand, when the developer, the increases in the bulk volume and the permeability of which are saturated because the developer is left unattended for a long time, is agitated by the screw members in the first carrying chamber and the second carrying chamber, the air is caught between the toner particles and between the magnetic carriers and a triboelectric charging amount of the toner particles increases. Therefore, after leaving the developer in the first carrying chamber and the second carrying chamber unattended for a long period, when so-called idle agitation for rotating the screw members without performing development is started, as shown in FIG. 13, the bulk volume rapidly falls from immediately after the start of the idle agitation until about three minutes passes. This is because the air is caught in the developer and a triboelectric charging amount of the toner particles suddenly increases. Thereafter, although a rate of the fall in the bulk volume is reduced, the bulk volume gradually falls as idle agitation time passes. This is because the triboelectric charging amount of the toner particles increases little by little according to the abrasion of an externally added agent added to the toner particles. Specifically, as shown in FIG. 14, an externally added agent H for improving fluidity of toner powder is added to toner particles T. When the externally added agent H is gradually abraded according to the idle agitation of the developer, a frictional force among the toner particles T gradually increases. The increase in the triboelectric charging amount of the toner particles is nearly saturated until about three minutes passes from immediately after the start of the idle agitation. Thereafter, when the frictional force among the toner particles T is gradually increased by the abrasion of the externally added agent H, the triboelectric charging amount of the toner particles T gradually increases according to the increase in the frictional force. Consequently, in a period after three minutes from the start of the idle agitation, the bulk volume of the developer gradually falls as time passes. The toner particles T in a default state are shown in FIG. 14. When 30 minutes pass from the start of the idle agitation, the toner particles T are in a state shown in FIG. 15. The fluidity and the bulk volume can be measured by the metal powder apparent concentration test method of JIS Z2504: 2000.

Figure 16:
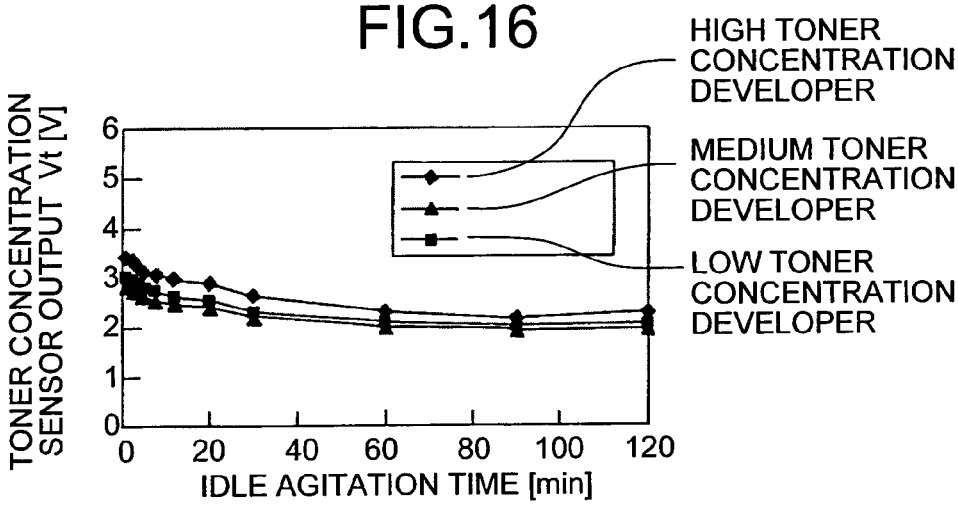
FIG. 16 is a graph of a relation between toner concentration sensor output Vt [volt] and idle agitation time [minute]
Figure 17:
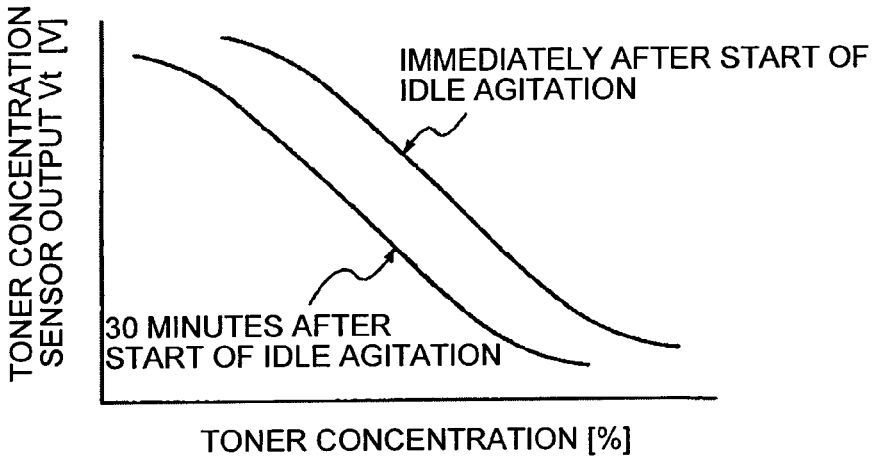
FIG. 17 is a graph of a relation between toner concentration sensor output Vt [volt] and toner concentration [percentage]

As described above, the bulk volume of the developer gradually falls over a long time as the idle agitation time passes. As shown in FIG. 16, the permeability of the developer (a toner concentration sensor output Vt) gradually falls and a result of the detection of the toner concentration gradually worsens. Then, a large difference shown in FIG. 17 occurs in the toner concentration sensor output Vt between the time immediately after the start of the idle agitation and the time 30 minutes after the start, although the toner concentration of the developer is fixed. This causes misdetection of a toner concentration.

In the developing device disclosed in Japanese Patent Application Laid-Open No. 6-308833, for the purpose of preventing the occurrence of such misdetection, a pressure of a developer in an area where a toner concentration is detected by a toner concentration sensor in the entire area of a developer carrying unit is set higher than pressures of the developer in the other areas. However, this pressure indicates a pressure in the conveying direction of the developer (the rotation axis direction of the screw members). According to the experiments by the inventors, a satisfactory correlation is not established between such a pressure and a degree of occurrence of the misdetection.

Figure 18:
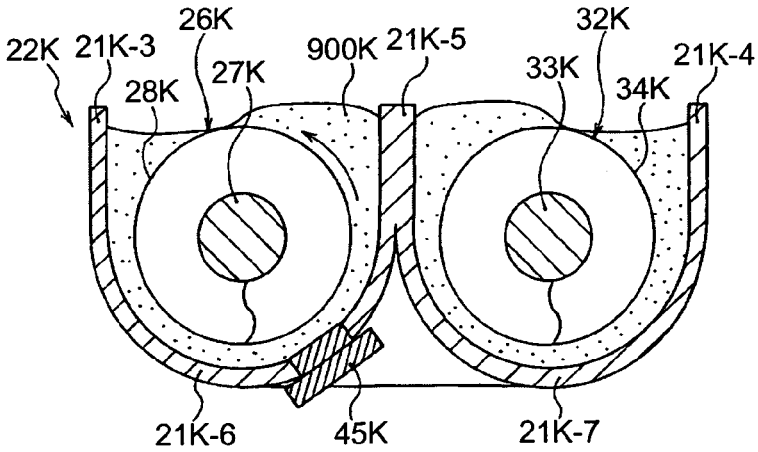
FIG. 18 is an enlarged diagram of a developer carrying device of a developing device for black (K)

FIG. 18 is an enlarged diagram of the developer carrying device 22K in the developing device for K. In the figure, in the first carrying chamber including a first screw member 26K for K, a bottom wall 21K-6 thereof is opposed to the lower side in the gravity direction of the first screw member 26K via a predetermined gap. A left side plate 21K-3 is opposed to one of both lateral sides orthogonal to the rotation axis direction of the first screw member 26K via a predetermined gap. A partition wall 21K-5 is opposed to the other of both the lateral sides via a predetermined gap. A K developer 900K is stored not only in a spiral blade 28K of the first screw member 26K but also in a clearance between the outer edge of the spiral blade 28K and the left side plate 21K-3, a clearance between the outer edge of the spiral blade 28K and the bottom wall 21K-6, and a clearance between the outer edge of the spiral blade 28K and the partition wall 21K-5. The K toner concentration sensor 45K fixed to the casing of the developing device cannot detect a K toner concentration of the K developer in the spiral blade 28K at a relatively long distance because the K toner concentration sensor 45K has a relatively small detectable distance range. The K toner concentration sensor 45K can only detect a K toner concentration of the K developer 900K stored in the clearance between the spiral blade 28K and the bottom wall 21K-6. Therefore, the K developer 900K in the clearance has to be sufficiently pressed. However, a pressing force generated by the rotation of the first screw member 26K mainly acts on the K developer 900K stored in the spiral blade 28K in the conveying direction (the rotation axis direction). Even if the K developer 900K in the spiral blade 28K is sufficiently pressed in the conveying direction, the K developer 900K in the clearance may not be sufficiently pressed. Consequently, a satisfactory correlation is not established between a pressure in the convention direction applied to the developer and a degree of occurrence of misdetection of a toner concentration.

The inventors also found the developing device shown in the figure has a deficiency described below. When the K developer 900K is not pressed against the surface of the K toner concentration sensor 45K with a sufficient pressure according to the rotation of the first screw member 26K, the replacement of the K developer 900K near the K toner concentration sensor 45K is not actively performed. Regardless of the fact that the first screw member 26K rotates many times, the same K developer 900K stays near the K toner concentration sensor 45K for a long time and the K toner concentration of the K developer 900K continues to be detected. Consequently, a substantial change in the K toner concentration of the K developer 900K is not quickly detected.

Figure 19:
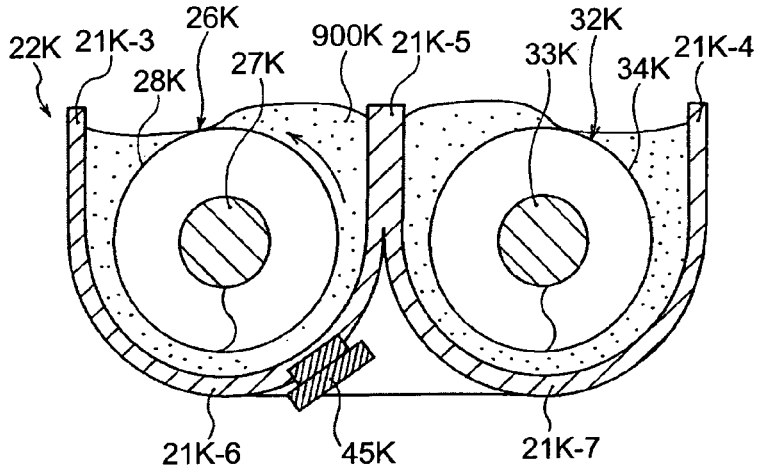
FIG. 19 is an enlarged diagram of another embodiment of a developer carrying device of a developing device for black (K) in which a wall is interposed between a K toner concentration sensor and a K developer in a first carrying chamber.

Therefore, it is necessary to increase a pressing force in the screw rotation direction and press the developer strongly against a permeability detection surface of the toner concentration sensor instead of increasing a pressing force in the screw axis direction (the conveying direction) on the developer. In FIG. 18, the permeability detection surface of the K toner concentration sensor 45K is brought into contact with the K developer 900K in the first conveying chamber. However, as shown in FIG. 19, a wall (in the example shown in the figure, the bottom wall 21K-6) of the first carrying chamber can be interposed between the K developer 900K in the first carrying chamber and the K toner concentration sensor 45K. Then, it is necessary to press the K developer 900K strongly against the wall, which is interposed between the K developer 900K and the K toner concentration sensor 45K, by a rotation force of the first screw member 26K.

A characteristic structure of the copying machine according to this embodiment is explained.

Figure 20:
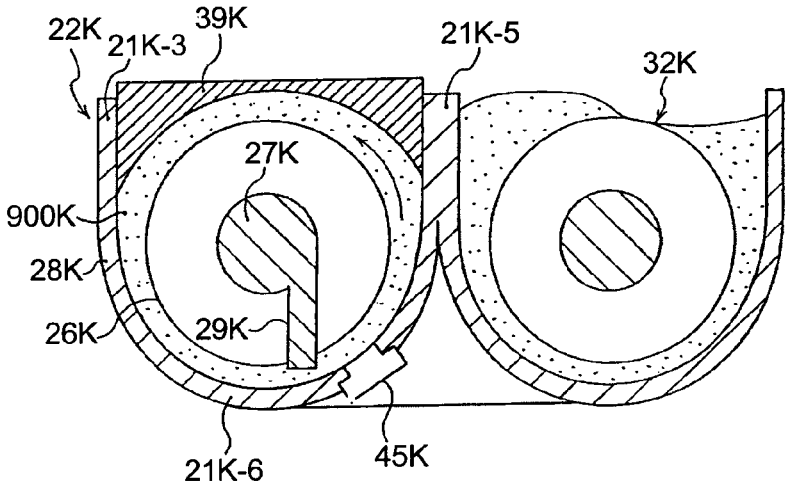
FIG. 20 is a cross sectional view of the developer carrying device for K shown in FIG. 18.

FIG. 20 is a cross sectional view of the developer carrying device 22K for K. In the figure, the first carrying chamber including the first screw member 26K has a pressing wall 39K. The pressing wall 39K is provided at least in a part of the entire area of the first carrying chamber as the developer carrying unit. Specifically, the pressing wall 39K is provided in an area opposed to the bottom wall 21K-6 of the first carrying chamber on the lower side in the gravity direction of the first screw member 26K and opposed to the side walls (the left side plate 21K-3 and the partition wall 21K-5) of the first carrying chamber on both lateral sides orthogonal to the rotation axis direction of the first screw member 26K. In the area, the K toner concentration of the K developer being carried is detected by the K toner concentration sensor 45K (e.g., an area indicated by an alternate long and short dash line X in FIG. 12).

As shown in FIG. 20, the pressing wall 39K is laid over between the left side plate 21K-3 and the partition wall 21*k*-5 of the first carrying chamber and covers the first carrying chamber from above. A curved surface along a curvature of the spiral blade 28K is formed on a surface of the pressing wall 39K opposed to the first screw member 26K. Such a pressing wall 39K comes into contact with, from above in the vertical direction, the K developer 900K moving upward from the lower side in the gravity direction according to the rotation of the first screw member 26K and presses the K developer 900K downward in the vertical direction. The pressing wall 39K pushes out the K developer 900K present in a spiral space of the first screw member 26K in a rotation radial direction of the first screw member 26K while compressing the K developer 900K. Then, a part of the K developer 900K stored in the spiral space of the first screw member 26K is pushed out into the clearance between the outer edge of the spiral blade 28K and the bottom wall 21K-6 of the first carrying chamber to press the K developer 900K present near the detection surface of the K toner concentration sensor 45K strongly to the sensor. Therefore, misdetection of a toner concentration due to fluctuation in a volume of the toner can be further reduced than in the past by pressing the K developer 900K strongly against the detection surface of the K toner concentration sensor 45K.

Figure 21:
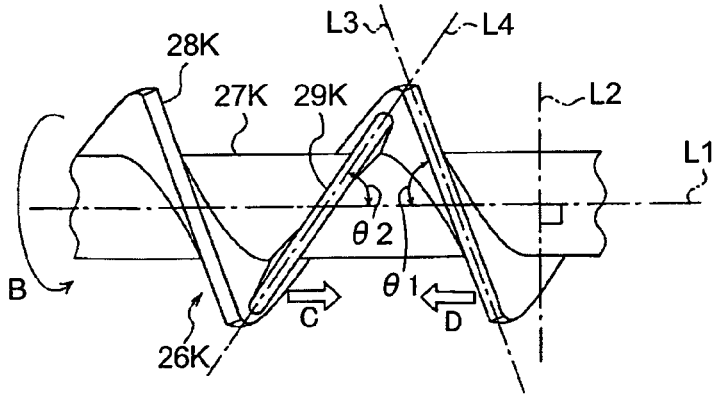
FIG. 21 is an enlarged side view of a part of a first screw member for K shown in FIG. 20.

The copying machine includes a reverse carrying blade 29K in the first screw member 26K in addition to the pressing wall 39K in the first carrying chamber to further reduce misdetection of a toner concentration due to fluctuation in a volume of the toner. Specifically, FIG. 21 is an enlarged side view of a part of the first screw member 26K for K in the copying machine. In the figure, a rotation shaft member 27K is driven to rotate in an arrow B direction in the figure. The spiral blade 28K is protrudingly provided on the peripheral surface of the rotation shaft member 27K to have a slope with an angle θ1 with respect to the rotation axis direction of the rotation shaft member 27K (an extending direction of a line L1). There are four angles formed by the line L1 and a line L3 extending in the direction of the spiral blade 28K on the peripheral surface of the rotation shaft member 27K. Among the four angles, each two angles are the same angles because the angles are vertical angles. Thus, there are two angles formed by crossing of the line L1 and the line L3. An angle θ1 represents a smaller one of these angles (θ2 described later is the same).

In the spiral blade 28K of the first screw member 26K, the reverse carrying blade 29K is protrudingly provided on the peripheral surface of the rotation shaft member 27K between two opposed surfaces that face the rotation axis direction (the extending direction of the line L1). An extending direction of the reverse carrying blade 29K (an extending direction of a line L4) on the peripheral surface of the rotation shaft member 27K has the inclination opposite to that of the spiral blade 28K with respect to the extending direction of the line L1. An angle of the inclination is θ2.

The spiral blade 28K carries the not-shown K developer in an arrow D direction in the figure along the rotation axis direction according to the rotation around the rotation shaft member 27K. On the other hand, the reverse carrying blade 29K carries the K developer in an arrow C direction opposite to the carrying direction of the spiral blade 28K according to the rotation around the rotation shaft member 27K. The reverse carrying blade 29K is protrudingly provided in a section of the rotation shaft member 27K in an area, a lower side in the gravity direction of which is opposed to the bottom wall of the first carrying chamber (21K-6 in FIG. 19) as the developer carrying unit and both lateral sides orthogonal to the rotation axis direction of which are opposed to the sidewalls of the first carrying chamber (21K-3 and 21K-5 in FIG. 19), respectively, in the entire area in the rotation axis direction in the first screw member 26K. Although the reverse carrying blade 29K is not shown in FIGS. 18 and 19 for convenience of illustration, the K toner concentration sensor 45K is disposed to detect the K toner concentration of the K developer carried between the reverse carrying blade 29K and a spiral blade section (a section extending along the line L3 in FIG. 21) adjacent to the reverse carrying blade 29K.

The K developer carried to the reverse carrying blade 29K and the K developer carried to the spiral blade section adjacent to the reverse carrying blade 29K (a reverse carrying blade adjacent section) bump into each other between the reverse carrying blade 29K and the reverse carrying blade adjacent section. Consequently, the K developer is pushed out in the normal direction. The K developer present near the detection surface of the toner concentration sensor 45K in the clearance between the outer edge of the first screw member 26K and the bottom wall (21K-6) of the first carrying chamber is pressed strongly to the detection surface. According to the increase in the pressing force by the reverse carrying blade 29K and the increase in the pressing force by the pressing wall 39, misdetection of a toner concentration due to fluctuation in a volume of the toner is further reduced. Further, the developer near the detection surface is actively replaced by retracting the developer from the detection surface while being pressed strongly against the detection surface according to the rotation of the reverse carrying blade 29K. Consequently, it is possible to further reduce misdetection of a toner concentration due to the fluctuation in a volume of the toner by preventing the developer from staying near the detection surface and always supplying a new developer to the detection surface.

Figure 22:
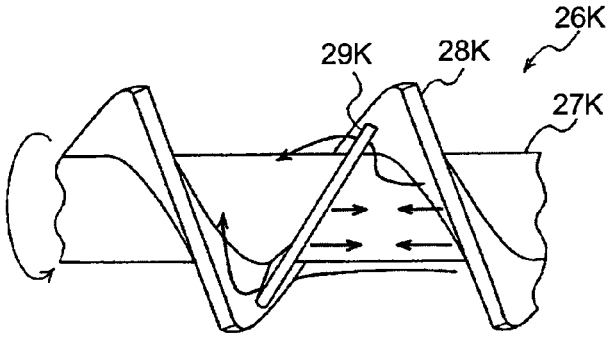
FIG. 22 is an enlarged side view for explaining the flow of the K developer in the first screw member for K shown in FIG. 20.

Two opposed surfaces in the spiral blade 28K opposed to each other across the reverse carrying blade 29K are not connected to the reverse carrying blade 29K. Gaps are formed between the opposed surfaces and the reverse carrying blade 29K. Therefore, a part of the K developers that bump into each other because of the opposite movements between the reverse carrying blade 29K and the reverse carrying blade adjacent section of the spiral blade 28K is carried along the spiral space while passing through the gaps as shown in FIG. 22.

Figure 23:
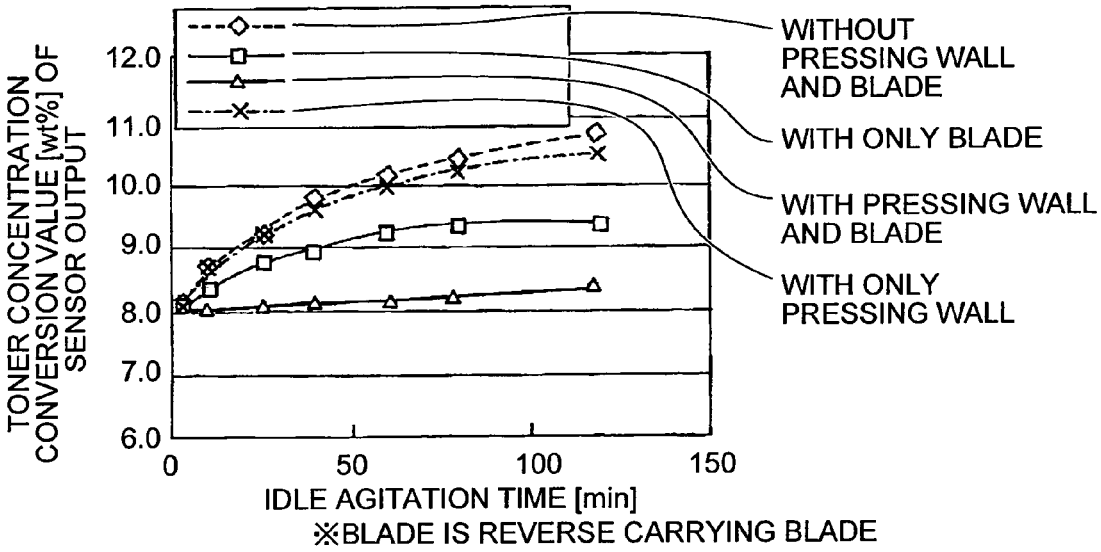
FIG. 23 is a graph of a relation between a toner concentration conversion value [weight percentage] of the toner concentration sensor output Vt [volt] and an idle agitation time [minute] at the time when the K developer having a K toner concentration of 8 [weight percentage] is idly agitated.

FIG. 23 is a graph of a relation between a toner concentration conversion value [wt %] of the toner concentration sensor output Vt [V] and an idle agitation time [min] at the time when the K developer having a K toner concentration of 8 [wt %] is idly agitated. It is seen from the graph that an amount of misdetection of a toner concentration is reduced when the first screw member including the reverse carrying blade is used. It is also seen that, when the reverse carrying blade is provided, a lower toner concentration can be detected when a pressing wall is provided than when the pressing wall is not provided. Moreover, it is seen that, when the reverse carrying blade 29K is provided in addition to the pressing wall 39K, toner densities of substantially the same values continue to be detected from immediately after the start of the idle agitation until 120 minutes passes. This is because misdetection of a toner concentration due to a change in a bulk volume of the developer is substantially eliminated. For reference, a relation between the toner concentration sensor output Vt [V] and the toner concentration [wt %] is shown in FIG. 24.

Figure 24:
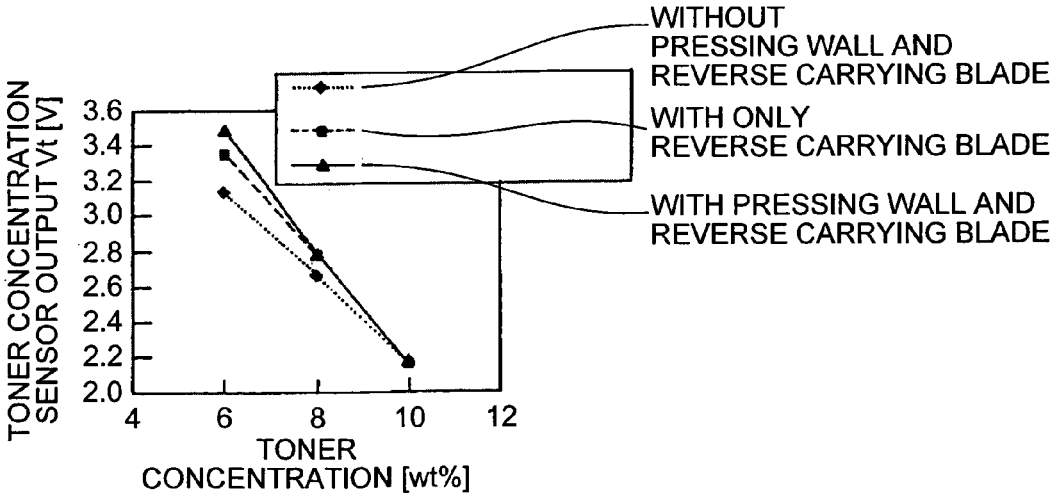
FIG. 24 is a graph of a relation between the toner concentration sensor output Vt [volt] and the toner concentration [weight percentage]
Figure 25:
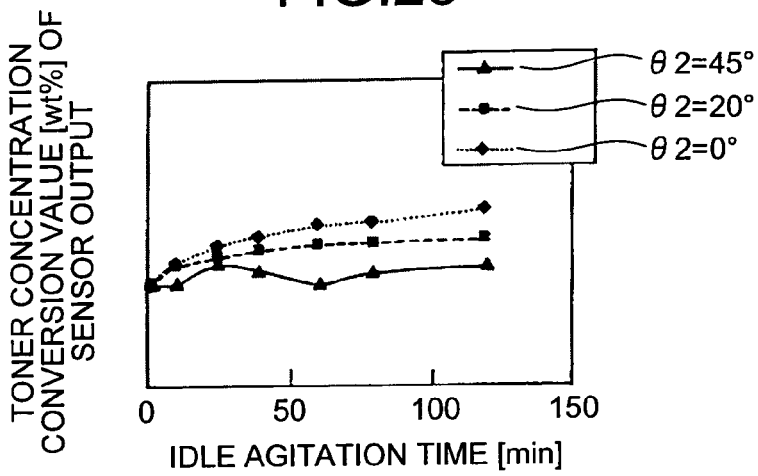
FIG. 25 is a graph of characteristics of toner concentration conversion values [weight percentage] of sensor outputs [volt] for angle θ2 shown in FIG. 21 of 45 degrees, 20 degrees, and 0 degree.
Figure 26:
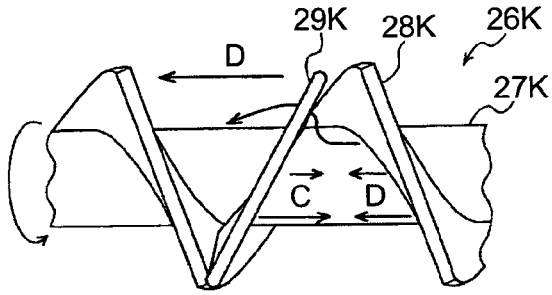
FIG. 26 is an enlarged side view of a part of still another embodiment of a developer carrying device of a developing device for black (K) in which only one end side of the reverse carrying blade is connected to a spiral blade.

In experiments in which the data in FIGS. 23 and 24 are acquired, a screw member described below is used as the first screw member. A disposing pitch in the screw rotation axis direction of the spiral blade is 25 [mm], an inclination angle θ2 from the axial direction of the reverse carrying blade is 45 [°], and a projection height from a rotation shaft member surface of the reverse carrying blade is the same as the height of the spiral blade. The reverse carrying blade of the first screw member is connected to a blade of the spiral blade, a downstream end in the developer carrying direction of which is adjacent to the reverse carrying blade on a downstream side in the developer carrying direction, between blades of the spiral blade as shown in FIG. 26. On the other hand, a gap is provided as shown in the figure between an upstream end in the developer carrying direction of the reverse carrying blade and a blade of the spiral blade adjacent to the reverse carrying blade on an upstream side in the developer carrying direction. The developer in the first screw member is carried while passing through this gap. As the toner concentration sensor, a toner concentration sensor, a diameter of a detection surface of which is 5 [mm], is used. The toner concentration sensor is disposed to place the center of the detection surface in a position opposed to an intersection point of the line L3 and the line L4 in FIG. 21. As the pressing wall (e.g., 39K), a pressing wall, a length in the screw axis direction (a length in the developer carrying direction) of which is 25 [mm], and that covers the entire ceiling of the first carrying chamber and covers only a part of the area in the developer carrying direction of the first carrying chamber as shown in FIG. 20 is used. Experiments were carried out under the same conditions except the inclination angle θ2 when data in FIG. 25 was acquired.

In FIG. 20, as the angle θ2 with respect to the line L2 of the reverse carrying blade 29K is set closer to 45 [°], a developer carrying ability in the arrow C direction by the reverse carrying blade 29K can be improved. When the angle θ2 is set smaller than 45 [°], as the angle θ2 is set smaller, a developer carrying ability in the rotating direction is improved at the cost of the low developer carrying ability in the arrow C direction. When the angle θ2 is set to 0 [°], the developer carrying ability in the rotating direction is the highest. In the experiments carried out by the inventors, an amount of misdetection of a toner concentration could be further reduced when the reverse carrying blade 29K was provided at the angle θ2 larger than 0 [°] than when the angle θ2 was set to 0 [°] (the developer could be pressed more strongly on the detection surface of the toner concentration sensor). When the angle θ2 was set to 45 [°], i.e., when the developer carrying ability in the arrow C direction was the highest, an amount of misdetection of a toner concentration could be reduced most. For reference, characteristics of toner concentration conversion values of sensor outputs at the angle θ2 of 45 [°], 20 [°], and 0 [°] are shown in FIG. 25.

Figure 27:
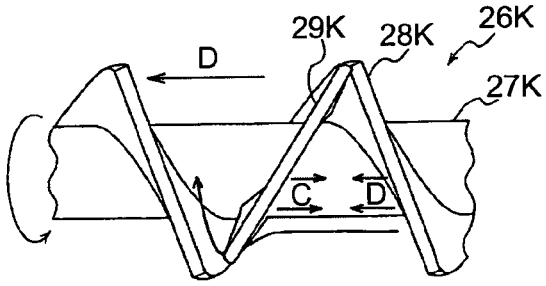
FIG. 27 is an enlarged side view of a part of still another embodiment of a developer carrying device of a developing device for black (K) in which only the other end side of the reverse carrying blade is connected to the spiral blade.
Figure 28:
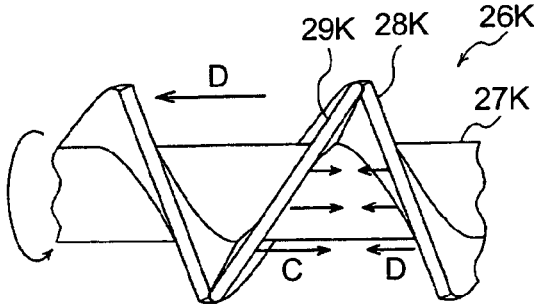
FIG. 28 is an enlarged side view of a part of still another embodiment of a developer carrying device of a developing device for black (K) in which two opposed surfaces of the spiral blade are bridged by the reverse carrying blade.

As shown in FIG. 22, gaps are provided between the two opposed surfaces of the spiral blade 28K and the reverse carrying blade 29K, respectively. The not-shown K developer stored between the opposed surfaces smoothly moves along the spiral space while passing through the gap. It is not always necessary to provide the gaps between the two opposed surfaces and the reverse carrying blade 29K. However, it is desirable to at least provide a gap between one opposed surface and the reverse carrying blade 29K as shown in FIGS. 26 and 27. This is because, when the two opposed surfaces are bridged by the reverse carrying blade 29K as shown in FIG. 28, the conveyance of the K developer in the regular direction (the arrow D direction in the figure) along the rotation axis direction is considerably hindered by the reverse carrying blade 29K to clog the section below the pressing wall 39K with the K developer.

Figure 29:
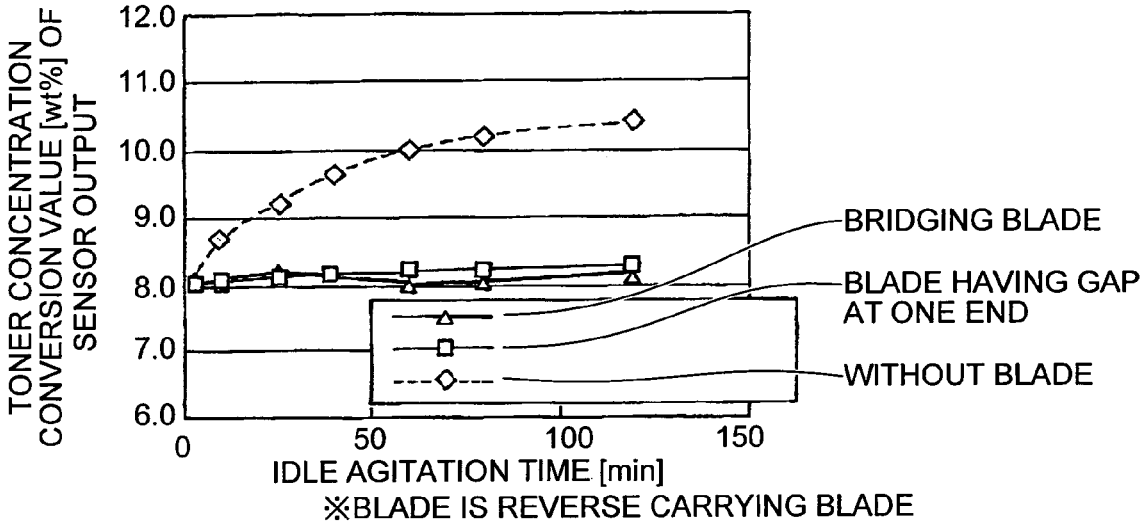
FIG. 29 is a graph of characteristics of toner concentration conversion values [weight percentage] of sensor outputs [volt] for three cases: when the reverse carrying blade is not provided, when both ends of the reverse carrying blade are bridged in the spiral blade, and when both the ends of the reverse carrying blade are not connected to the spiral blade.

For reference, detection characteristics of a toner concentration at the time when the gaps are provided between the two opposed surfaces and the reverse carrying blade 29K and at the time when the two opposed surfaces are bridged by the reverse carrying blade 29K are shown in FIG. 29. Only from the viewpoint of pressing the developer strongly against the toner concentration sensor to reduce an amount of misdetection of a toner concentration, it is preferable to bridge the two opposed surfaces with the reverse carrying blade 29K as shown in the figure. However, when the two opposed surfaces were bridged and a continuous print operation was actually performed, the section below the pressing wall is clogged with the developer immediately after the supply of the toner.

Figure 31:
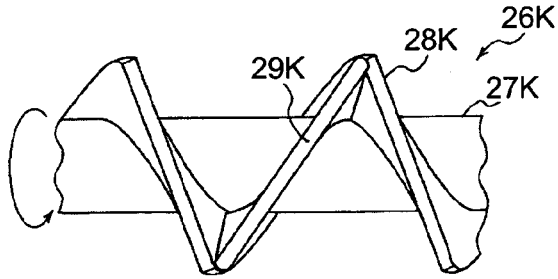
FIG. 31 is an enlarged side view of still another embodiment of a developer carrying device of a developing device for black (K) in which a twisted blade is provided as the reverse carrying blade.

In the experiments in which the data in FIG. 29 is acquired, a screw member described below is used as the first screw member having the reverse carrying blade. A disposing pitch in the screw rotation axis direction of the spiral blade is 25 [mm], an inclination angle θ2 from the axial direction of the reverse carrying blade is 45 [°], and a projection height from a rotation shaft member surface of the reverse carrying blade is the same as the height of the spiral blade. The reverse carrying blade of the first screw member is joined to the spiral blade at both an upstream end and a downstream end in a slightly twisted shape as shown in FIG. 31. Alternatively, as shown in FIG. 26, a gap is formed between the downstream end in the developer carrying direction and the spiral blade. As the toner concentration sensor, a toner concentration sensor, a diameter of a detection surface of which is 5 [mm], is used. The toner concentration sensor is disposed to place the center of the detection surface in a position opposed to the intersection point of the line L3 and the line L4 in FIG. 21. As the pressing wall (e.g., 39K), a pressing wall, a length in the screw axis direction (a length in the developer carrying direction) of which is 25 [mm], and that covers the entire ceiling of the first carrying chamber and covers only a part of the area in the developer carrying direction of the first carrying chamber is used.

Figure 30:
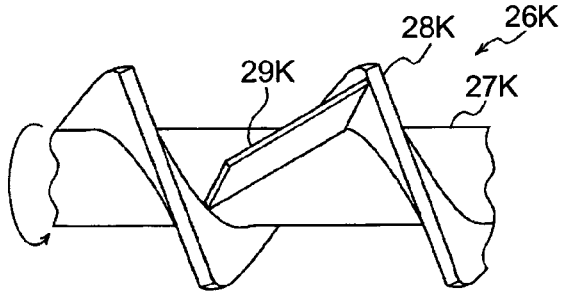
FIG. 30 is an enlarged side view of still another embodiment of a developer carrying device of a developing device for black (K) in which a flat rectangular blade is provided as the reverse carrying blade.
Figure 32:
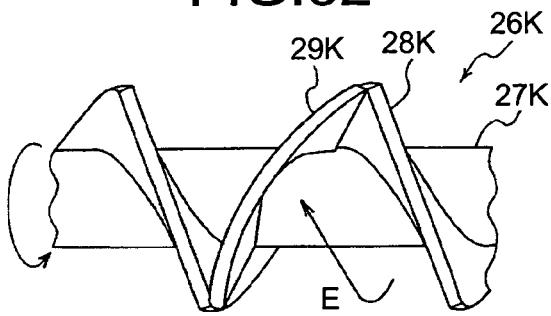
FIG. 32 is an enlarged side view of still another embodiment of a developer carrying device of a developing device for black (K) in which a hollow blade is provided as the reverse carrying blade.
Figure 33:
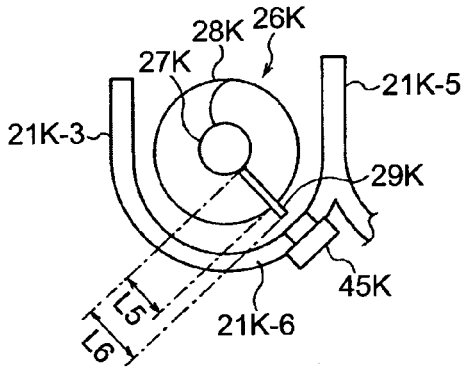
FIG. 33 is a cross sectional view of the first screw member fractured in a section of the reverse carrying blade.

As the reverse carrying blade 29K, besides the reverse carrying blade 29K of the shape shown in FIG. 22, the reverse carrying blade 29K of a flat rectangular shape (a tabular shape) shown in FIG. 30, the reverse carrying blade 29K of a twisted shape shown in FIG. 31, the reverse carrying blade 29K of a shape hollowed toward the moving direction of the K developer (an arrow E direction in the figure) in the spiral space (a curved shape) shown in FIG. 32, or the like can be adopted. A parallel fin and a forward direction fin as blade members described later can also be fins of the tabular shape, the twisted shape, or the curved shape.

As shown in FIGS. 19 and 20, the toner concentration sensor (e.g., 45K) is disposed to detect a toner concentration of a developer further below in the gravity direction than the rotation axis center of the first screw member 26K as the agitating and carrying member (the center of the rotation shaft member 27K). In the first carrying chamber in which the first screw member 26K is housed, a developer storage quantity in the developer carrying direction slightly fluctuates over time. Thus, a developer surface (an upper surface level) of the developer also fluctuates slightly in a certain degree of range. In such a first carrying chamber, when the toner concentration sensor 45K is dispose to detect a toner concentration of a developer further above in the gravity direction than the center of the rotation shaft member 27K, it is likely that timing for locating the developer surface below the sensor is generated. When the developer surface is located below the sensor, more significant misdetection occurs because the toner concentration cannot be detected. On the other hand, when the toner concentration sensor 45K is disposed to detect a toner concentration of a developer further below in the gravity direction than the center of the rotation shaft member 27K, occurrence of such misdetection can be prevented. This is because, even if the developer storage quantity fluctuates in the first carrying chamber, the developer surface of the developer does not fall below the center of the rotation shaft member 27K.

In FIG. 20, the first screw member 26K is shown from a side on which the first screw member 26K looks rotating in the counterclockwise direction. When the first screw member 26K and a peripheral structure thereof are seen from such a side, the pressing wall 39K is disposed from a position of a first quadrant (upper right of the screw) to a position of a second quadrant (upper left of the screw) to cover the entire area in the width direction of the first carrying chamber. The toner concentration sensor 45K is disposed in a position of a fourth quadrant around the screw (lower right of the screw).

Figure 36:
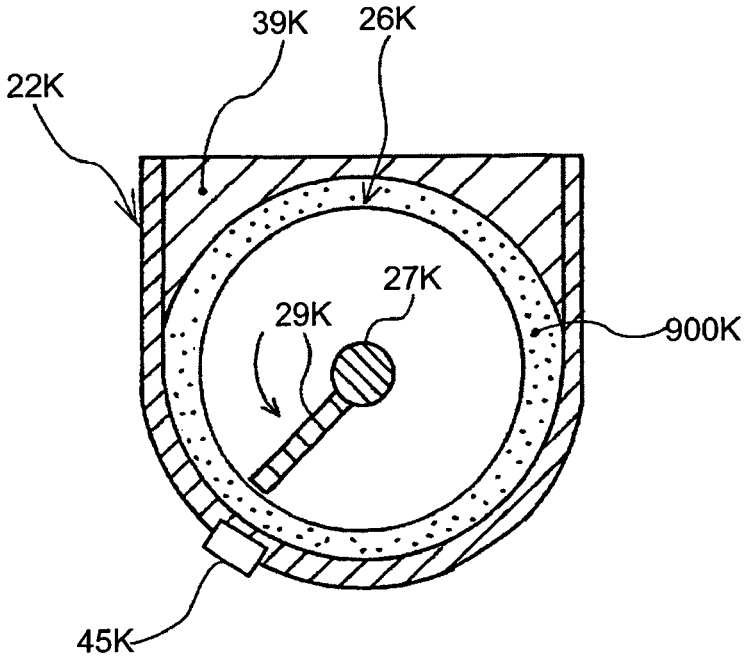
FIG. 36 is a sectional view of another embodiment of a first agitation chamber in which a toner concentration sensor is provided in a third quadrant.

As shown in FIG. 36, the toner concentration sensor 45K can be disposed in a position of a third quadrant (lower left of the screw) instead of the fourth quadrant (lower right of the screw). In the position of the fourth quadrant, as explained with reference to FIG. 20, the developer is moved from the lower side to the upper side in the gravity direction according to the rotation of the reverse carrying blade 29K. On the other hand, the developer is pressed downward in the gravity direction by the pressing wall 39K to be pushed out in the rotation radius direction (the normal direction) of the first screw member 26K while being compressed. Consequently, in the fourth quadrant, the developer present near the detection surface of the toner concentration sensor 45K in the clearance between the outer edge of the first screw member 26K and the bottom wall 21K-6 of the first carrying chamber is pressed strongly to the detection surface. In FIG. 36, the third quadrant is adjacent to the fourth quadrant on the upstream side in the developer carrying direction. In such a third quadrant, a pressing force on the developer generated in the fourth quadrant is propagated from the fourth quadrant. Thus, the developer present near the detection surface of the toner concentration sensor 45K in the clearance is pressed to the detection surface with a pressing force weaker than that in the fourth quadrant. This makes it possible to prevent occurrence of misdetection of a toner concentration. However, a return force by the pressing wall 39K acting on the developer is larger in the third quadrant. Whereas the developer is about to move downward in the gravity direction with an own weight thereof, the reverse carrying blade 29K is about to lift the developer in the opposite direction. As a result, the pressing force of the developer against the detection surface becomes larger. Therefore, an amount of misdetection of a toner concentration can be further reduced.

As described above, in the form shown in FIG. 20, the toner concentration sensor 45K is disposed in the fourth quadrant to detect a toner concentration of the developer that is given a downward pressing force from above in the gravity direction by the pressing wall 39 while moving upward from below in the gravity direction according to the rotation of the first screw member 26K. Therefore, an amount of misdetection of a toner concentration can be further reduced than when the toner concentration sensor 45K is disposed in the third quadrant in which the developer is moved downward from above in the gravity direction according to the rotation of the first screw member 26K.

In the copying machine, the pressing wall 39K is provided only in a part of the entire area in the developer carrying direction in the first carrying chamber as the developer carrying unit. Specifically, the pressing wall 39K is provided only in the area where the reverse carrying blade 29K is provided in the first screw member 26K in the entire area of the first carrying chamber. When a pressure of the developer considerably rises right below the pressing wall 39K, it is possible to cause the developer present further on the upstream side in the developer carrying direction than the pressing wall 39K to flow over the pressing wall 39 according to the increase in the pressure and behave to prevent a further increase in the pressure. This makes it possible to prevent the section right below the pressing wall 39K from being clogged with the developer. On the other hand, if the entire area in the developer carrying direction is covered with the pressing wall 39K, it is likely that clogging of the section right below the pressing wall 39K by the developer occurs.

Figure 37:
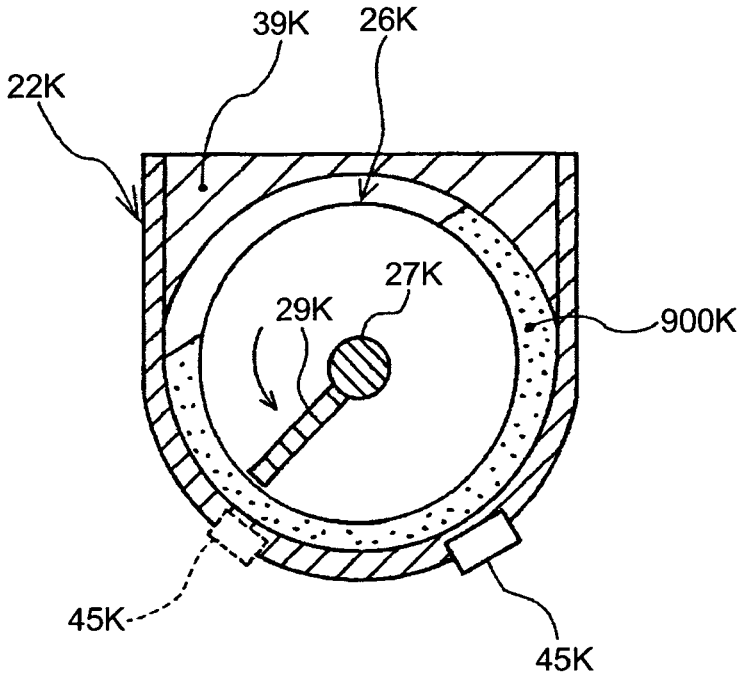
FIG. 37 is a sectional view of still another embodiment of a first agitation chamber in which a developer is not filled in a clearance between a pressing wall and the first screw member.

As shown in FIGS. 20 and 36, the entire area around the first screw member 26K does not always have to be filled with the developer right below the pressing wall 39K. As shown in FIG. 37, a developer storage quantity can be only enough for filling the clearance between the screw and the pressing wall 39K except the second quadrant (upper left of the screw) among the four quadrants. Even if the developer storage quantity is relatively small in this way, if the clearance in the first quadrant (upper right of the screw) is filled with the developer, a return force by the pressing wall 39K is given to the developer moved upward from below in the gravity direction in the first quadrant. This makes it possible to press the developer strongly to the detection surface of the toner concentration sensor 45K in the fourth quadrant (lower right of the screw) and the third quadrant (lower left of the screw).

Figure 38:
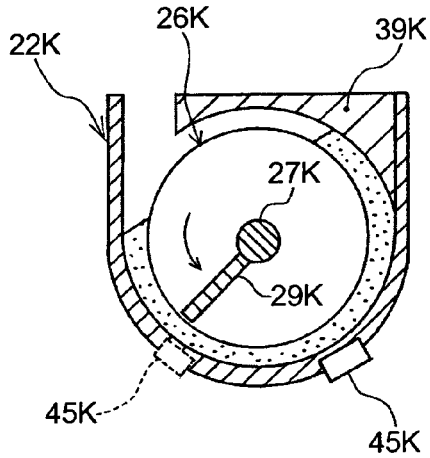
FIG. 38 is a sectional view of still another embodiment of a first agitation chamber in which a pressing wall is not provided in a second quadrant.

It is not always necessary to provide the pressing wall 39K to cover the entire area in the width direction of the first carrying chamber. This is because, if the pressing wall 39K is disposed to cover at least the first quadrant (upper right of the screw) as shown in FIG. 38, the developer can be pressed strongly to the detection surface of the toner concentration sensor 45K in the third quadrant (lower left of the screw) and the fourth quadrant (lower right of the screw).

An amount of projection L6 of the reverse carrying blade 29K in the normal direction from the peripheral surface of the rotation shaft member 27K is set larger than an amount of projection L5 of the spiral blade 28K in the normal direction from the peripheral surface of the rotation shaft member 27K. The tip of the reverse carrying blade 29K that has moved to the position opposed to the K toner concentration sensor 45K according to the rotation of the first screw member 26K is brought closer to the sensor than the tip of the spiral blade 28K to press the K developer more strongly to the sensor than when the amount of projection L6 is set equal to or smaller than the amount of projection L5. This makes it possible to reduce an amount of misdetection of a K toner concentration.

Figure 34:
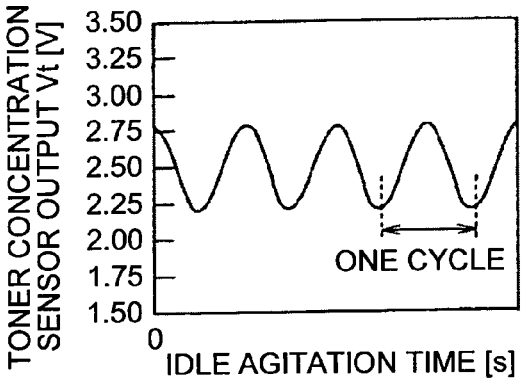
FIG. 34 is a graph of a relation between the toner concentration sensor output Vt [volt] and the idle agitation time [second] during idle agitation.

FIG. 34 is a graph of a relation between the toner concentration sensor output Vt [V] during idle agitation and an idle agitation time [s]. As shown in the figure, the relation between the toner concentration sensor output Vt and the idle agitation time is a waveform of a sine curve shape. This is because a pressing force of the developer applied to the toner concentration sensor 45K is the largest when the reverse carrying blade 29K of the first screw member 26K passes the area opposed to the toner concentration sensor 45K according to the rotation of the reverse carrying blade 29K. When a pressure sensor is attached instead of the K toner concentration detection sensor 45K in the developer carrying device 22K for K, a relation between the K toner concentration sensor output Vt and an elapsed time is also a waveform of a sine curve shape like the waveform shown in the figure. A period of the waveform is the same as a period of the waveform in FIG. 34. At timing when the reverse carrying blade 29K passes the position opposed to the K toner concentration sensor 45K according to the rotation of the first screw member 26K, the toner concentration sensor output Vt is the highest (a max point of the sine curve) and a K toner concentration is accurately detected.

In the copying machine that shows such detection characteristics, when the toner concentration sensor output Vt at timing at a lower limit point of the sine curve is adopted for toner concentration control or the toner concentration sensor output Vt at timing at an upper limit point is adopted for toner concentration control, accurate toner concentration control is difficult because an amount of misdetection fluctuates. Thus, in the copying machine, the control unit 500 as the control means acquires the toner concentration sensor output Vt a plurality of number of times in a predetermined period and, then, extracts, out of results of the detection, results having values higher than an average in a plurality of detection results and controls driving of the toner supplying unit based on a result of the extraction. Therefore, a toner concentration can be more accurately controlled than when the toner concentration sensor output Vt at an upper limit time or a lower limit time is adopted at random.

Figure 35:
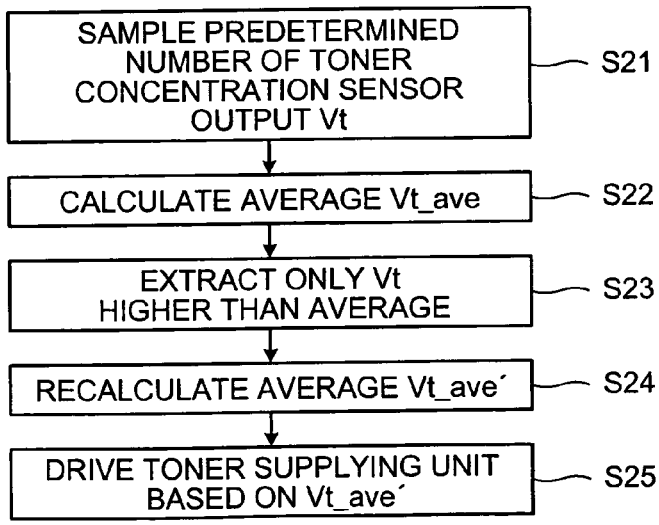
FIG. 35 is a flowchart of a toner concentration control processing carried out by the control unit shown in FIG. 5.

FIG. 35 is a flowchart of a toner concentration control processing carried out by the control unit 500. In the figure, a flow of toner concentration control processing for only one color is shown. However, in actual use, the same toner concentration control processing is carried out in parallel for the respective colors of Y, C, M, and K. In the figure, first, a predetermined number of toner concentration sensor output Vt are sampled at predetermined intervals at predetermined timing (step S21). After calculating an average Vt_ave of sampling data of the sampling (step S22), the control unit 500 extracts only the toner concentration sensor outputs Vt larger than the average Vt_ave among the sampled toner concentration sensor outputs Vt (step S23). After recalculating an average of only the extracted data (step S24), the control unit 500 drives the toner supplying unit for a time corresponding to a recalculation result Vt_ave' to supply the toner (step S25).

In the example explained above, the left side plate 21K-3 and the partition wall 21K-5 of the first carrying chamber is bridged by the pressing wall 39K. However, it is not always necessary to bridge the left side plate 21K-3 and the partition wall 21K-5. If it is possible to bring the pressing wall 39K into contact with the K developer, which moves from the lower side to the upper side in the gravity direction according to the rotation of the first screw member 26K, from above in the gravity direction, the pressing wall 39K may be partially provided between the left side plate 21K-3 and the partition wall 21K-5. The developer carrying device 22K for K has been explained. However, the developer carrying devices for the other colors have structures same as that of the developer carrying device 22K for K.

Modifications of the copying machine according to the embodiment are explained below. Unless specifically noted otherwise, structures of copying machines according to the modifications are the same as that in the embodiment.

Figure 39:
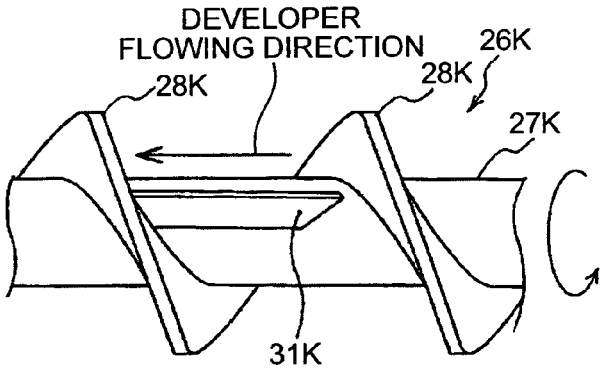
FIG. 39 is an enlarged side view of a part of a first example of a first screw member in a developing device for K.

FIG. 39 is an enlarged side view of a part of the first screw member 26K in a developing device for K of a copying machine according to a first modification. In the first screw member 26K, a parallel fin 31K as a blade member is protrudingly provided on the peripheral surface of the rotation shaft member 27K instead of the reverse carrying blade. The parallel fin 31K is protrudingly provided on the peripheral surface of the rotation shaft member 27K in a posture extending in the axial direction of the rotation shaft member 27K. The parallel fin 31K moves a developer in the normal direction (the rotation radius direction) of the first screw member 26K according to the rotation of the parallel fin 31K. This makes it possible to press the developer strongly to a detection surface of a not-shown toner concentration sensor. Moreover, the developer present near the detection surface is actively replaced by retracting the developer from the detection surface while being pressed strongly against the detection surface according to the rotation of the parallel fin 31K. As a result, misdetection of a toner concentration due to fluctuation in a volume of the toner can be reduced.

Figure 40:
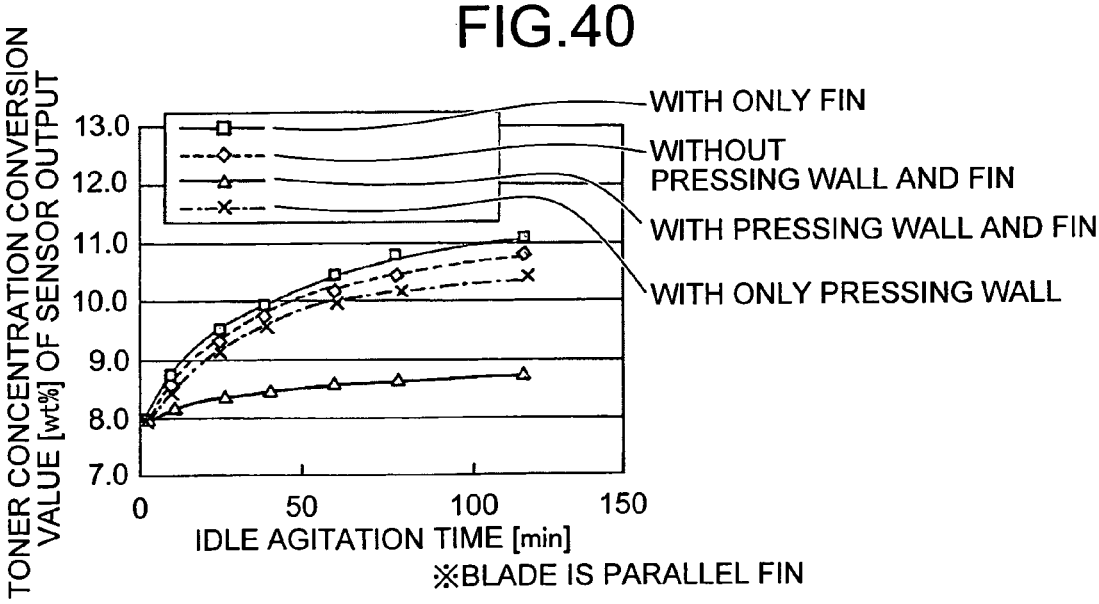
FIG. 40 is a graph of a relation between a toner concentration conversion value [weight percentage] of a toner concentration sensor output Vt [volt] and an idle agitation time [minute] at the time when a K developer having a K toner concentration of 8 [weight percentage] is idly agitated in the first example.

FIG. 40 is a graph of a relation between a toner concentration conversion value [wt %] of the toner concentration sensor output Vt [V] and an idle agitation time [min] at the time when a K developer having a K toner concentration of 8 [wt %] is idly agitated in the first screw member 26K shown in FIG. 39. As shown in the figure, it is seen that an amount of error detection of a toner concentration increases according to an increase in the idle agitation time when a first screw member including a parallel fin is used and a pressing wall is not provided, when the first screw member not including the parallel fin is used and the pressing wall is not provided, and when the first screw member not including the parallel fin is used and the pressing wall is provided. On the other hand, it is seen that toner densities of substantially the same values continue to be detected until 120 minutes passes from immediately after the start of idle agitation when the first screw member including the parallel fin is used and the pressing wall is provided. In view of this experimental result, in the developing device according to the first modification, the first screw member 26K including the parallel fin 31K is used and the pressing wall is provided in the first carrying chamber.

Figure 41:
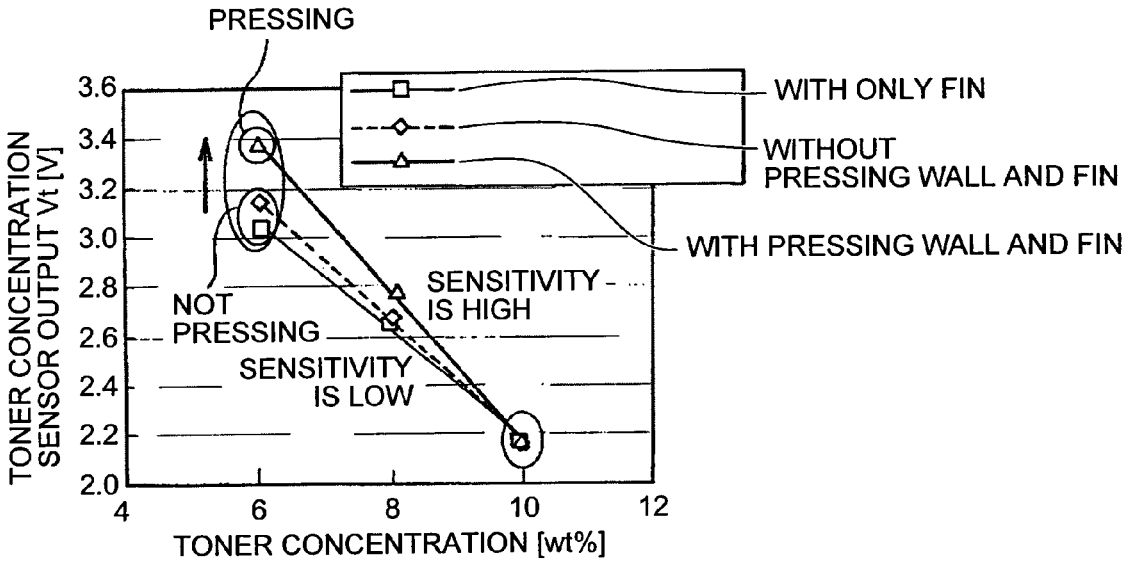
FIG. 41 is a graph of a relation between the toner concentration sensor output Vt [volt] and a toner concentration [weight percentage] in the first example.

For reference, a relation between the toner concentration sensor output Vt [V] and a toner concentration [wt %] is shown in FIG. 41. When the pressing wall is not provided, the developer moved upward from below in the gravity direction according to the rotation of the first screw member is not pushed back downward in the gravity direction. Therefore, the developer is not pressed in the clearance and an amount of error detection of a toner concentration is larger than when the pressing wall is provided.

In experiments in which the data in FIGS. 40 and 41 are acquired, a screw member described below is used as the first screw member. A disposing pitch in the screw rotation axis direction of the spiral blade is 25 [mm] and a projection height from the surface of the rotation shaft member of the parallel fin is the same as that of the spiral blade. The parallel fin of the first screw member is connected to a blade of the spiral blade, a downstream end in the developer carrying direction of which is adjacent to the parallel fin on a downstream side in the developer carrying direction, between blades of the spiral blade as shown in FIG. 39. On the other hand, a gap is provided as shown in the figure between an upstream end in the developer carrying direction of the parallel fin and a blade of the spiral blade adjacent to the parallel fin on an upstream side in the developer carrying direction. The developer in the first screw member is carried while passing through this gap. As the toner concentration sensor, a toner concentration sensor, a diameter of a detection surface of which is 5 [mm], is used. The toner concentration sensor is disposed to place the center of the detection surface in a position opposed to the center in the rotation axis direction of the parallel fin. As the pressing wall (e.g., 39K), a pressing wall, a length in the screw axis direction (a length in the developer carrying direction) of which is 25 [mm], and that covers the entire ceiling of the first carrying chamber and covers only a part of the area in the developer carrying direction of the first carrying chamber as shown in FIG. 20 is used.

As described already, the parallel fin can be a flat rectangular fin, a twisted fin shown in FIG. 30, a hollow fin, a fin, Mylar, or a fin with Mylar integral with the rotation shaft member or the spiral blade, and the like.

Figure 42:
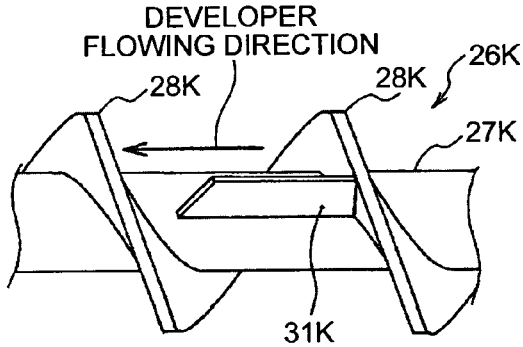
FIG. 42 is an enlarged side view of a part of a second example of the first screw member in the developing device.

FIG. 42 is an enlarged side view of a part of a second example of the first screw member 26K in the developing device for K of the copying machine according to the first modification. The parallel fin 31K in the first screw member 26K in the second example is connected to a blade of the spiral blade, an upstream end in the developer carrying direction of which is adjacent to the parallel fin 31K on an upstream side in the developer carrying direction, between blades of the parallel fin 31K. On the other hand, a gap is provided as shown in the figure between a downstream end in the developer carrying direction of the parallel fin 31K and a blade of the spiral blade adjacent to the parallel fin 31K on a downstream side in the developer carrying direction. The developer in the first screw member is carried while passing through this gap. Therefore, the developer can be actively replaced near the detection surface of the toner concentration sensor while being pressed strongly to the toner concentration sensor according to the rotation of the parallel fin 31K.

Figure 43:
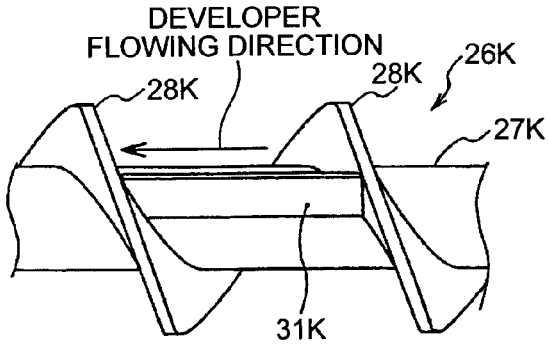
FIG. 43 is an enlarged side view of a part of a third example of the first screw member in the developing device.

FIG. 43 is an enlarged side view of a part of a third example of the first screw member 26K in the developing device for K of the copying machine according to the first modification. The parallel fin 31K in the first screw member 26K in the third example is connected to the spiral blade 28K at both an upstream end and a downstream end in the developer carrying direction between blades of the spiral blade 28K and bridges the blades of the spiral blade 28K. Therefore, the developer can be actively replaced near the detection surface of the toner concentration sensor while being pressed strongly to the toner concentration sensor according to the rotation of the parallel fin 31K.

Figure 44:
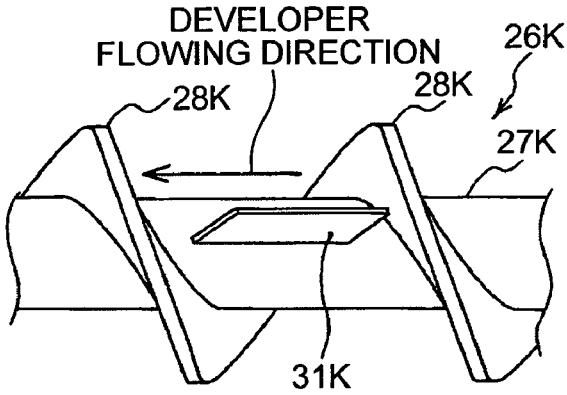
FIG. 44 is an enlarged side view of a part of a fourth example of the first screw member in the developing device.

FIG. 44 is an enlarged side view of a part of a fourth example of the first screw member 26K in the developing device for K of the copying machine according to the first modification. At both an upstream end and a downstream end in the developer carrying direction of the parallel fin 31K in the first screw member 26K in the fourth example, gaps are formed between the upstream end and the downstream end and the spiral blade. The developer is carried while passing through the gaps. Therefore, the developer can be actively replaced near the detection surface of the toner concentration sensor while being pressed strongly to the toner concentration sensor according to the rotation of the parallel fin 31K.

Figure 45:
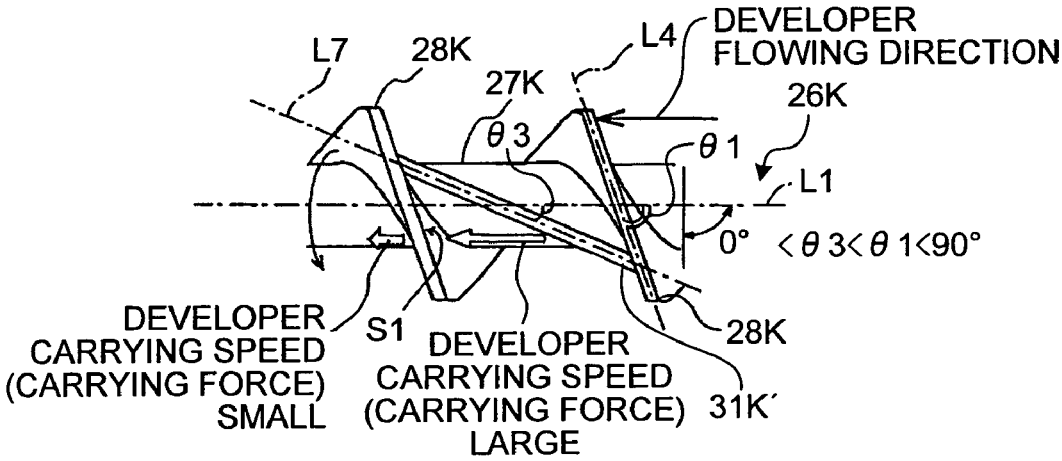
FIG. 45 is an enlarged side view of a part of a first example of a first screw member in a developing device for K of a copying machine according to a second modification.

FIG. 45 is an enlarged side view of a part of the first screw member 26K in a developing device for K of a copying machine according to a second modification. In the first screw member 26K, a forward carrying fin 31K' is protrudingly provided on the peripheral surface of the rotation shaft member 27K instead of the reverse carrying blade. The forward carrying fin 31K' bridges blades of the spiral blade 28K. An inclination angle θ3 thereof is smaller than the inclination angle θ1 of the spiral blade 28K ($0°<\theta 3<\theta 1<90°$). The forward carrying fin 31K' provided at such an inclination angle θ3 carries a developer at speed higher than that of the spiral blade 28K in a direction relatively the same as that of the spiral blade 28K.

Between the forward carrying fin 31K' and the spiral blade 28K, the forward carrying fin 31K' superior in the developer carrying speed presses the developer against the surface (a surface indicated by S1 in the figure) of the spiral blade 28K inferior in the developer carrying speed. A part of the developer pressed against the surface of the spiral blade 28K moves in the normal direction of the first screw member 26K along the surface of the spiral blade 28K. The part of the developer flows to the outside of the first screw member 26K and is pressed strongly against a detection surface of a not-shown toner concentration sensor. Consequently, the developer present near the detection surface of the toner concentration sensor is pressed strongly to the detection surface. The developer is retracted from the detection surface while being pressed strongly against the detection surface according to the rotation of the forward carrying fin 31K' to actively replace the developer present near the detection surface. As a result, misdetection of a toner concentration due to fluctuation in a volume of a toner can be further reduced than in the past.

There are four angles formed by the line L1 extending in the rotation axis direction of the first screw member 26K and a line L7 extending in an extending direction of the forward carrying fin 31K' on the peripheral surface of the rotation shaft member 27K. Among the four angles, each two angles are the same angles because the angles are vertical angles. Thus, there are two angles formed by crossing of the line L1 and the line L7. An angle θ3 represents a smaller one of these angles. The angle θ3 of the forward carrying fin 31K' does not always have to satisfy the condition "$0°<\theta 3<\theta 1<90°$" as long as the angle θ3 takes a value with which the developer can be pressed against the pressing wall.

Figure 46:
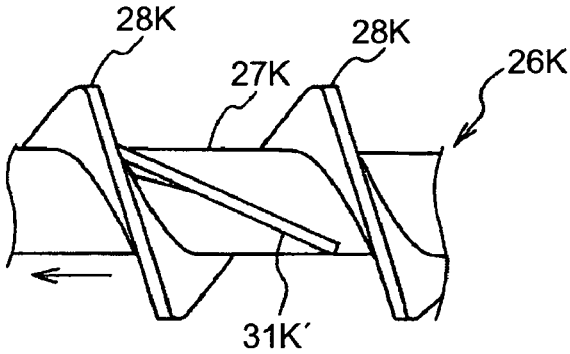
FIG. 46 is an enlarged side view of a part of a second example of the first screw member in the developing device.

FIG. 46 is an enlarged side view of a part of a second example of the first screw member 26K in the developing device for K of the copying machine according to the second modification. The forward carrying fin 31K' in the first screw member 26K in the second example is connected to a blade of a spiral blade, a downstream end in the developer carrying direction of which is adjacent to the forward carrying fin 31K' on a downstream side in the developer carrying direction, between blades of the spiral blade 28K. On the other hand, a gap is provided as shown in the figure between an upstream end in the developer carrying direction of the forward carrying fin 31K' and a blade of the spiral blade adjacent to the forward carrying fin 31K' on an upstream side in the developer carrying direction. The developer in the first screw member is carried while passing through this gap. Therefore, the developer can be actively replaced near the detection surface of the toner concentration sensor while being pressed strongly to the toner concentration sensor according to the rotation of the forward carrying fin 31K'.

Figure 47:
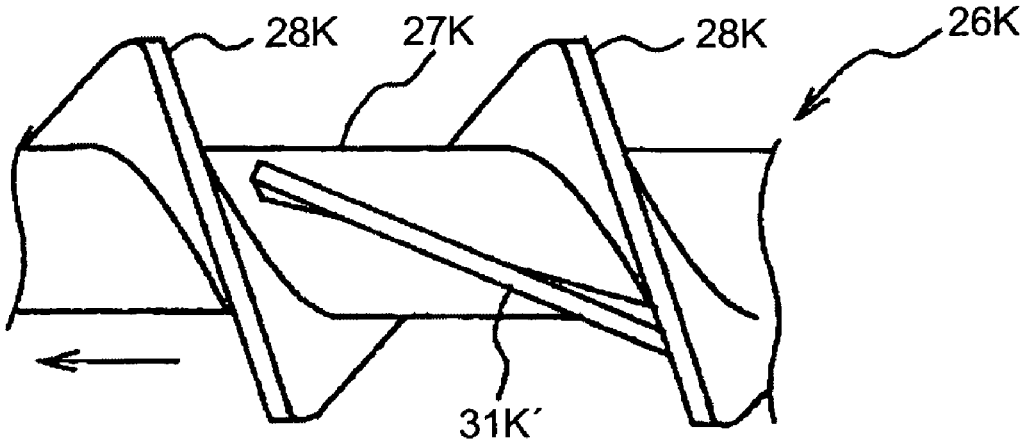
FIG. 47 is an enlarged side view of a part of a third example of the first screw member in the developing device.

FIG. 47 is an enlarged side view of a part of a third example of the first screw member 26K in the developing device for K of the copying machine according to the second modification. The forward carrying fin 31K' in the first screw member 26K in the third example is connected to a blade of a spiral blade, a downstream end in the developer carrying direction of which is adjacent to the forward carrying fin 31K' on a downstream side in the developer carrying direction, between blades of the spiral blade 28K. On the other hand, a gap is provided as shown in the figure between a downstream end in the developer carrying direction of the forward carrying fin 31K' and a blade of the spiral blade adjacent to the forward carrying fin 31K' on a downstream side in the developer carrying direction. The developer in the first screw member is carried while passing through this gap. Therefore, the developer can be actively replaced near the detection surface of the toner concentration sensor while being pressed strongly to the toner concentration sensor according to the rotation of the forward carrying fin 31K'.

Figure 48:
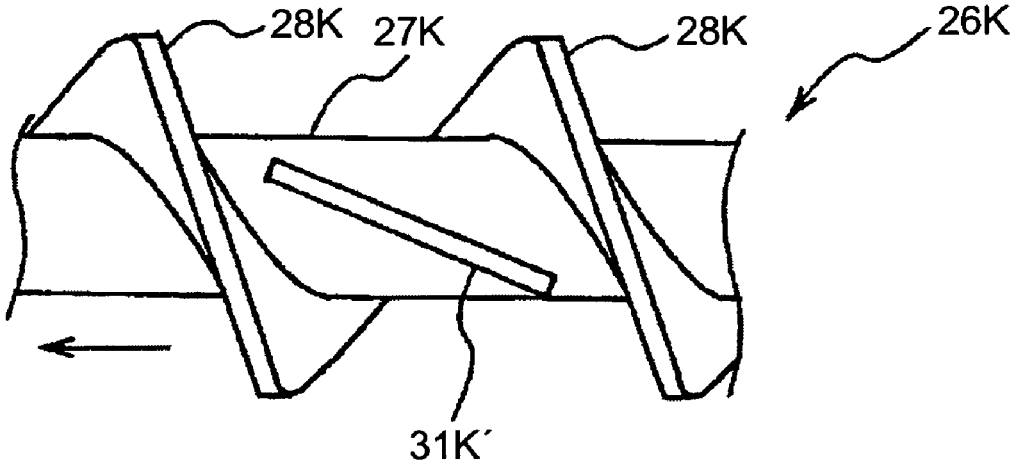
FIG. 48 is an enlarged side view of a part of a fourth example of the first screw member in the developing device.

FIG. 48 is an enlarged side view of a part of a fourth example of the first screw member 26K in the developing device for K of the copying machine according to the second modification. At both an upstream end and a downstream end in the developer carrying direction of the forward carrying fin 31K' in the first screw member 26K in the fourth example, gaps are formed between the upstream end and the downstream end and the spiral blade. The developer is carried while passing through the gaps. Therefore, the developer can be actively replaced near the detection surface of the toner concentration sensor while being pressed strongly to the toner concentration sensor according to the rotation of the forward carrying fin 31K'.

As described already, the parallel fin can be a flat rectangular fin, a twisted fin shown in FIG. 30, a hollow fin, a fin, Mylar, or a fin with Mylar integral with the rotation shaft member or the spiral blade, and the like.

The toner concentration sensor 45K is disposed to detect a toner concentration of a developer further below in the gravity direction than the rotation center of the first screw member 26K. Therefore, as explained already, significant misdetection of a toner concentration, which occurs because a developer surface is located below the toner concentration sensor, can be prevented from occurring.

Moreover, the toner concentration sensor 45K is disposed in the fourth quadrant to detect a toner concentration of the developer that is given a downward pressing force from above in the gravity direction by the pressing wall 39 while moving upward from below in the gravity direction according to the rotation of the first screw member 26K. As explained already, an amount of misdetection of a toner concentration can be further reduced than when the toner concentration sensor 45K is disposed in the third quadrant.

The first screw member 26K including the rotatably-supported rotation shaft member 27K and the spiral blade 28K protrudingly provided in a spiral shape on the peripheral surface of the rotation shaft member 27K is used as the agitating and carrying member. The reverse carrying blade 29K that carries the K developer in the direction opposite to the carrying direction of the spiral blade 28K according to the rotation of the rotation shaft member 27K is protrudingly provided in the area opposed to the pressing wall 39K of the entire area in the rotation axis direction in the rotation shaft member 27K. As described above, the pressing force of the K developer against the K toner concentration sensor 45K is increased by pressing the K developer with the pressing wall 39K and is also increased by carrying the K developer in the opposite direction in the area opposed to the sensor with the reverse carrying blade 29K. This makes it possible to further reduce misdetection of a toner concentration due to fluctuation in a volume of a toner. Moreover, the developer is retracted from the detection surface while being pressed strongly against the detection surface according to the rotation of the reverse carrying blade 29K to actively replace the developer present near the detection surface. As a result, an amount of misdetection of a toner concentration can also be substantially eliminated.

The screw member including the rotatably-supported rotation shaft member 27K and the spiral blade 28K protrudingly provided in a spiral shape on the peripheral surface of the rotation shaft member 27K is used. The parallel fin 31K or the forward carrying fin 31K' as the blade member that moves the developer in the normal direction according to the rotation of the rotation shaft member 27K or moves the developer in the direction same as the direction of carrying by the spiral blade 28K is protrudingly provided in the area opposed to the pressing wall 39K in the entire area in the rotation axis direction in the rotation shaft member 27K. Therefore, the developer can be actively replaced near the detection surface of the toner concentration sensor while being pressed strongly to the toner concentration sensor according to the rotation of the parallel fin 31K or the forward carrying fin 31K'.

The reverse carrying blade 29K is disposed between the two opposed surfaces opposed in the rotation axis direction in the spiral blade 28K. The gap is provided between at least one of the two opposed surfaces and the reverse carrying blade 29K. As described above, clogging of the section below the pressing wall 39K by the K developer can be further prevented than when the gap is not provided.

The amount of projection L6 of the reverse carrying blade 29K in the normal direction from the peripheral surface of the rotation shaft member 27K is set larger than the amount of projection L5 of the spiral blade 28K in the normal direction from the peripheral surface of the rotation shaft member 27K. Therefore, an amount of misdetection of a toner concentration can be further reduced than when the amount of projection L6 is set equal to or smaller than the amount of projection L5.

The pressing wall 39K is provided only in a part of the entire area in the developer carrying direction in the first carrying chamber. Therefore, as explained above, clogging of the section right below the pressing wall 39K by the developer can be prevented.

The control unit 500 acquires results of detection by the toner concentration sensor as the toner concentration detecting means a plurality of number of times, then, extracts only results with values higher than an average in the acquired results, and controls driving of the toner supplying unit based on a result of the extraction. Therefore, as described above, a toner concentration can be more accurately controlled than when a detection result at a random point in time is directly adopted.

The developer that moves from the lower side to the upper side in the gravity direction according to the rotation of the agitating and carrying member is pressed downward in the gravity direction with the pressing wall to push out the developer in the agitating and carrying member in the rotation radius direction of the agitating and carrying member while compressing the developer. The developer present near the detection surface of the toner-concentration detecting unit in the clearance between the outer edge of the agitating and carrying member and the wall of the developer carrying unit is pushed strongly to the detection surface with the developer pushed out in the rotation radius direction from the inside of the agitating and carrying member. Misdetection of a toner concentration due to fluctuation in a volume of a toner can be further reduced than in the past by pressing the developer strongly to the detection surface of the toner-concentration detecting unit in this way.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The invention claimed is:

1. A developing device comprising:

a developer carrying device that carries a developer containing a toner and a carrier;

a developer sleeve member that carries the developer, which is carried by the developer carrying device, to an area opposed to a latent-image bearing member according to surface movement of the developer sleeve member while bearing the developer on an endlessly-moving surface thereof, a latent image born on the latent-image bearing member being developed, wherein the developer carrying device includes: a developer carrying unit configured to carry the developer in a rotation axis direction while agitating the developer with rotation of an agitating and carrying member; and a toner-concentration detecting unit configured to detect a toner concentration in the developer carried in the developer carrying unit, wherein a pressing wall is provided in an area in a part of an entire area in the developer carrying direction in the developer carrying unit, the pressing wall having a curved surface facing the agitating and carrying member and the curved surface coming into contact with, from above in the gravity direction, the developer that moves from a lower side to an upper side in the gravity direction according to the rotation of the agitating and carrying member and pressing the developer downward in the gravity direction, the area is opposed to a bottom wall of the developer carrying unit on a lower side in a gravity direction of the agitating and carrying member and opposed to side walls of the developer carrying unit on both lateral sides orthogonal to the rotation axis direction of the agitating and carrying member such that the pressing wall extends completely between the side walls, and the toner concentration of the developer being carried is detected by the toner-concentration detecting unit in the area; and the agitating and carrying member includes: a screw member including a rotatably-supported rotation shaft member and a spiral blade protrudingly provided in a spiral shape on a peripheral surface of the rotation shaft member; and a reverse carrying blade that carries the developer in a direction opposite to a carrying direction of the spiral blade according to the rotation of the rotation shaft member is protrudingly provided in an area opposite to the pressing wall in the entire area in the rotation axis direction in the rotation shaft member, wherein the curved surface of the pressing wall is curved along a curvature of the spiral blade.

2. The developing device according to claim 1, wherein the toner-concentration detecting unit is arranged at a location that makes it possible to detect a toner concentration of the developer present further below in the gravity direction than a rotation center of the agitating and carrying member.

3. The developing device according to claim 1, wherein the toner-concentration detecting unit is arranged at a location that makes it possible to detect a toner concentration of the developer that is given a downward pressing force from above in the gravity direction by the pressing wall while moving upward from below in the gravity direction according to the rotation of the agitating and carrying member.

4. The developing device according to claim 1, wherein the agitating and carrying member includes plurality of spiral blades protrudingly provided in the spiral shape on the peripheral surface of the rotation shaft member, and the reverse carrying blade is protrudingly provided in area on the rotation shaft member between the spiral blades.

5. The developing device according to claim 4, wherein the reverse carrying blade is arranged between two opposed surfaces opposed in the rotation axis direction to each other in the spiral blade, and a gap is provided between at least one of the two opposed surfaces and the reverse carrying blade.

6. The developing device according to claim 5, wherein an amount of projection of the reverse carrying blade in a normal direction from the rotation shaft member is set larger than an amount of projection of the spiral blade in the normal direction from the rotation shaft member.

7. The developing device according to claim 1, wherein the pressing wall is provided only in a part of the entire area in the developer carrying direction in the developer carrying unit.

8. A process unit in an image forming apparatus including a latent-image bearing member that bears a latent image, a developing device that develops the latent image on the latent-image bearing member, and a transfer unit that transfers a visual image developed on the image bearing member onto a transfer member, the process unit holding at least the latent-image bearing member and the developing device in a common holding member as one unit and being detachably mounted integrally on in an image forming apparatus main body, wherein the developing device according to claim 1 is used as the developing device.

9. The process unit according to claim 8, wherein the toner-concentration detecting unit is arranged at a location that makes it possible to detect a toner concentration of the developer present further below in the gravity direction than a rotation center of the agitating and carrying member.

10. The process unit according to claim 8, wherein the toner-concentration detecting unit is arranged at a location that makes it possible to detect a toner concentration of the developer that is given a downward pressing force from above in the gravity direction by the pressing wall while moving upward from below in the gravity direction according to the rotation of the agitating and carrying member.

11. The process unit according to claim 8, wherein the agitating and carrying member includes plurality of spiral blades protrudingly provided in the spiral shape on the peripheral surface of the rotation shaft member, and the reverse carrying blade is protrudingly provided in area on the rotation shaft member between the spiral blades.

12. The process unit according to claim 11, wherein the reverse carrying blade is arranged between two opposed surfaces opposed in the rotation axis direction to each other in the spiral blade, and a gap is provided between at least one of the two opposed surfaces and the reverse carrying blade.

13. The process unit according to claim 12, wherein an amount of projection of the reverse carrying blade in a normal direction from the rotation shaft member is set larger than an amount of projection of the spiral blade in the normal direction from the rotation shaft member.

14. The process unit according to claim 8, wherein the pressing wall is provided only in a part of the entire area in the developer carrying direction in the developer carrying unit.

15. An image forming apparatus comprising:

a latent-image bearing member that bears a latent image; and a developing device that develops the latent image on the latent-image bearing member, wherein the developing device according to claim 1 is used as the developing device.

16. The image forming apparatus according to claim 15, wherein the toner-concentration detecting unit is arranged at a location that makes it possible to detect a toner concentration of the developer present further below in the gravity direction than a rotation center of the agitating and carrying member.

17. The image forming apparatus according to claim 15, wherein the toner-concentration detecting unit is arranged at a location that makes it possible to detect a toner concentration of the developer that is given a downward pressing force from above in the gravity direction by the pressing wall while moving upward from below in the gravity direction according to the rotation of the agitating and carrying member.

18. The image forming apparatus according to claim 15, wherein the agitating and carrying member includes plurality of spiral blades protrudingly provided in the spiral shape on the peripheral surface of the rotation shaft member, and the reverse carrying blade is protrudingly provided in area on the rotation shaft member between the spiral blades.

* * * * *